US008585049B2

(12) United States Patent
Fujita et al.

(10) Patent No.: US 8,585,049 B2
(45) Date of Patent: Nov. 19, 2013

(54) SHEET CONVEYANCE APPARATUS AND IMAGE FORMING APPARATUS WITH SKEW CONVEYANCE MECHANISM

(75) Inventors: Takashi Fujita, Kashiwa (JP); Takayuki Suzuki, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/495,825

(22) Filed: Jun. 13, 2012

(65) Prior Publication Data

US 2012/0256368 A1 Oct. 11, 2012

Related U.S. Application Data

(60) Continuation of application No. 13/014,502, filed on Jan. 26, 2011, now Pat. No. 8,205,879, which is a division of application No. 12/335,360, filed on Dec. 15, 2008, now Pat. No. 7,900,914.

(30) Foreign Application Priority Data

Dec. 19, 2007 (JP) ..... 2007-327405
Jun. 25, 2008 (JP) ..... 2008-166088

(51) Int. Cl.
*B65H 9/16* (2006.01)

(52) U.S. Cl.
USPC ..... 271/251; 271/248

(58) Field of Classification Search
USPC ..... 271/248–252, 242, 228, 235, 236, 243
See application file for complete search history.

(56) References Cited

U.S. PATENT DOCUMENTS

| | | | | | |
|---|---|---|---|---|---|
| 5,004,220 | A * | 4/1991 | Dreschel et al. | ..... | 271/184 |
| 5,657,983 | A * | 8/1997 | Fisk | ..... | 271/251 |
| 6,042,110 | A * | 3/2000 | Inage | ..... | 271/251 |
| 6,273,418 | B1 * | 8/2001 | Fujikura et al. | ..... | 271/228 |
| 6,993,282 | B2 * | 1/2006 | Kimizuka | ..... | 399/401 |
| 7,445,208 | B2 * | 11/2008 | Onodera | ..... | 271/239 |
| 7,571,908 | B2 * | 8/2009 | Inui et al. | ..... | 271/251 |
| 7,900,914 | B2 * | 3/2011 | Fujita et al. | ..... | 271/251 |
| 2010/0327519 | A1 * | 12/2010 | Miyazawa | ..... | 271/248 |

FOREIGN PATENT DOCUMENTS

| | | | |
|---|---|---|---|
| GB | 2208851 | A * | 4/1989 |
| JP | 58-047735 | A | 3/1983 |
| JP | 03-067853 | A | 3/1991 |
| JP | 08-175704 | A | 7/1996 |

* cited by examiner

*Primary Examiner* — Jeremy R Severson
(74) *Attorney, Agent, or Firm* — Canon USA Inc. IP Division

(57) ABSTRACT

A sheet conveyance apparatus includes a reference surface extending along a sheet conveyance direction and configured to regulate the position of a side edge of a sheet to be conveyed, a skew conveyance mechanism configured to convey the sheet obliquely so that the side edge of the sheet collides against the reference surface, and a sheet deforming unit configured to deform the side edge of the sheet when the sheet is conveyed toward the reference surface by the skew conveyance mechanism.

8 Claims, 23 Drawing Sheets

SHEET CONVEYANCE APPARATUS AND IMAGE FORMING APPARATUS WITH SKEW CONVEYANCE MECHANISM

CROSS-REFERENCE TO RELATED APPLICATIONS

This application is a continuation of U.S. application Ser. No. 13/014,502 filed Jan. 26, 2011, which is a divisional of U.S. patent application Ser. No. 12/335,360 filed Dec. 15, 2008 and issued as U.S. Pat. No. 7,900,914, which claims priority from Japanese Patent Application No. 2007-327405 filed Dec. 19, 2007, and Patent Application No. 2008-166088 filed Jun. 25, 2008, all of which are hereby incorporated by reference herein in their entirety.

BACKGROUND OF THE INVENTION

1. Field of the Invention

The present invention relates to a sheet conveyance apparatus for a printer, a facsimile machine, a copying machine, or a multifunction peripheral having a plurality of functions, and further relates to an image forming apparatus including the sheet conveyance apparatus.

2. Description of the Related Art

There are various image forming apparatuses, including an electrophotographic type, an offset printing type, and an inkjet type, which are conventionally used. For example, a conventional electrophotographic color image forming apparatus includes a plurality of photosensitive drums disposed in a straight line (referred to as "tandem type") or disposed along a circular path (referred to as "rotary type").

Among conventionally used image transfer methods, a method for directly transferring a toner image from a photosensitive drum to a sheet is referred to as a "direct transfer method". A method for transferring a toner image from a photosensitive drum to an intermediate transfer member and then transferring the toner image from the intermediate transfer member to a sheet is referred to as an "intermediate transfer method."

Compared to the offset printing machines, recent electrophotographic image forming apparatuses are advantageous in not requiring printing plates and are preferably used for Print On Demand (POD) services, according to which a small amount of printing can be flexibly performed. However, to attain expected task goals, image forming apparatuses dedicated to the POD services are required to perform high performances suitable for the POD services. In this respect, accuracy in positioning an image on a sheet is an important factor to be satisfied. For example, in an image forming apparatus configured to perform two-sided printing, the image positioning accuracy includes an accuracy of positional adjustment between images formed on front and reverse pages.

The position in a sheet conveyance direction, the position in a direction perpendicular to the sheet conveyance direction, a magnification rate of the image, and a skew amount of the sheet are example factors influencing the position of an image formed on a sheet. Thus, eliminating differences in these factors is a key to attain a satisfactory level of positioning accuracy.

For example, an image forming apparatus can perform electrical control to eliminate differences in the sheet conveyance position and the magnification of an image. However, correcting the skew of a sheet using electrical control is difficult. For example, to correct the position of a conveyed sheet, the apparatus can electrically control irradiation timing/position of a laser beam based on an image signal supplied to a photosensitive drum. For example, to correct the magnification of an image, the apparatus can electrically control the irradiation range of the laser beam emitted to the photosensitive drum.

On the other hand, to correct the skew of a sheet, electrically detecting a skew amount of a conveyed sheet and electrically forming an inclined image matching the inclined sheet so as to correct the position of an image relative to the sheet is feasible. However, when an image forming apparatus can adjust the inclination of an image for each sheet while forming a color image with three or four colors overlapping each other, deviations of respective colors in dot formation may change the tint of an image on each sheet depending on a skew amount of the sheet. Furthermore, a relatively long time is required to calculate an inclination of the image. Therefore, productivity of the apparatus decreases greatly. Thus, an appropriate mechanism or device for mechanically correcting the skew of a sheet is required.

The skew correction mechanisms are roughly classified into the following types (or groups).

A skew correction mechanism belonging to a general type includes a pair of registration rollers disposed on the upstream side of a transfer unit, which can eliminate a skew amount of a conveyed sheet (conveyed transfer material) by causing the leading edge of the sheet to collide against a nip portion of the registration rollers in a stopped state. This type of skew correction mechanism excessively conveys a sheet after the leading edge of the sheet reaches the nip portion of the registration rollers. Therefore, while the conveyed sheet deforms into a loop shape, the leading edge of the sheet can be aligned along the nip portion of the registration rollers so as to eliminate a skew amount.

A skew correction mechanism belonging to another type includes a calculation unit configured to calculate a skew amount of a sheet based on a detected inclination of the leading edge of the sheet and two independently driven rollers disposed in a direction perpendicular to the sheet conveyance direction. This type of skew correction mechanism independently changes the conveyance speed of each driving roller according to a calculated skew amount of a sheet, thereby causing the sheet to rotate in a predetermined direction to eliminate the skew.

Furthermore, a skew correction mechanism belonging to yet another type includes a reference surface extending along the sheet conveyance direction and skew rollers obliquely conveying a sheet toward the reference surface. The reference surface causes a conveyed sheet to change its orientation (reduce a skew amount) while regulating the side edge of the conveyed sheet.

An example skew correction mechanism configured to correct the orientation of a sheet while regulating the side edge of the sheet with the reference surface is described below with reference to the drawings.

FIGS. 23A and 23B illustrate a skew correction unit as seen from a sheet conveyance direction, according to which a sheet moves from the front side to the rear side of the drawing. The skew correction unit includes a skew correction roller 32 and a pressing roller 34, which can cooperatively hold a sheet S and obliquely convey the sheet S to a reference surface 311 of a reference guide unit 31. After the sheet S collides against the reference surface 311, the skew correction roller 32 and the pressing roller 34 cause the sheet S to rotate to change its orientation (reduces a skew amount) and start moving straight along the reference surface 311.

As illustrated in FIG. 23A, when a side edge of the sheet S is obliquely conveyed between the skew correction roller 32 and the pressing roller 34, the sheet S is guided by an upper guide 312 and a lower guide 313 of the reference guide unit 31. The upper guide 312 and the lower guide 313 prevent the sheet S from buckling. The method for correcting the skew of a sheet by causing a side edge of the sheet to change its orientation along a reference surface is advantageous in the following points.

When an image forming apparatus performs image formation processing on front and reverse sides (first and second pages) of a sheet, the image forming apparatus performs a switchback operation to switch leading/trailing edges of the sheet for the first and second pages. In this case, the apparatus does not switch the side edges of the sheet. The apparatus performs the skew correction on the first and second pages of a sheet similarly at the same position in a direction perpendicular to the sheet conveyance direction. Therefore, the skew correction method using a reference surface can accurately set a start position of an image relative to a side edge of a sheet. The apparatus can perform two-sided image formation processing without causing any deviation between images on the front and reverse sides of a sheet.

According to a method for performing skew correction at the leading edge of a sheet, a deviation between images on the first and second pages cannot be corrected if the deviation is caused in a direction perpendicular to the sheet conveyance direction. Namely, even if the skew correction ability is high, images formed on the front and reverse sides of a sheet may deviate relative to a side edge of the sheet.

In the POD market, image forming apparatuses are required to perform image formation on various types of recording materials, including plain paper different in grammage (e.g., not less than 40 $g/m^2$ and not greater than 350 $g/m^2$), coated sheet, film, and other special materials.

As described above, a representative skew correction method includes conveying a sheet obliquely toward a reference surface to cause the conveyed sheet to collide at its side edge against the reference surface and change its orientation so as to reduce a skew amount of the sheet. However, recent image forming apparatuses are required to use various types of sheets different in thickness and material. If a conveyed sheet is thin or made of a material having a lower stiffness, the sheet may buckle when it collides against the reference surface. As illustrated in FIG. 23B, if the sheet S has a lower stiffness, the sheet S may buckle in a clearance between the upper guide 312 and the lower guide 313 when the sheet S collides against the reference surface 311.

In this case, the skew correction cannot be performed accurately and accuracy in positioning an image on a sheet deteriorates correspondingly. Furthermore, paper jam may occur due to buckling of a sheet. The side edge of a sheet may be broken or damaged. In general, the clearance between the upper guide 312 and the lower guide 313 is set to be larger than the thickness of a thickest sheet processed by the image forming apparatus. Therefore, the clearance between the upper guide 312 and the lower guide 313 is not sufficiently narrow to prevent a thin sheet from buckling.

Hence, to surely convey a sheet while guiding a side edge of the sheet along the reference surface without causing any buckling, an apparatus discussed in Japanese Patent Application Laid-Open No. 2002-356250 includes a mechanism for adjusting the clearance between upper and lower guides according to the thickness of a sheet. The discussed conventional apparatus is operative to decrease the clearance between the upper and lower guides when the conveyed sheet is a thin sheet (i.e., a sheet having a lower stiffness). Therefore, the apparatus can surely guide the side edge of a sheet along the reference surface while preventing the sheet from buckling.

However, according to the above-described conventional apparatus configured to adjust the clearance between the upper and lower guides according to the thickness of a sheet, a detection unit is required to operate accurately. The detection unit is, for example, a contact-type sensor or a reflection-type optical sensor capable of directly detecting the thickness of a sheet. Another detection unit can detect the thickness of a sheet based on the displacement of a conveyance roller movable when it nips the sheet.

However, if the detection by such a detection unit is performed while a sheet is continuously conveyed and not stopped, a significant amount of detection error (e.g., approximately 10%) arises due to an up-and-down movement of the conveyed sheet and an eccentricity of each conveyance roller in addition to inherent errors caused by an individual sensor. Moreover, according to the method for detecting the thickness of a sheet based on a displacement amount of a conveyance roller movable when it nips a sheet, accurately detecting the thickness of a thin sheet is difficult because the displacement of the roller is small.

Furthermore, there is a method for adjusting the clearance between upper and lower guides based on sheet thickness information directly entered by a user, instead of automatically detecting the thickness of a sheet. In this case, a user is required to enter the sheet thickness information and may erroneously set the information.

Furthermore, compared to the thickness of a sheet, the stiffness of a sheet is a decisive factor to prevent a sheet from buckling when the sheet collides against a reference surface. FIG. 22 is a graph illustrating plots representing various types of sheets with respect to a relationship between the thickness of a sheet and the stiffness of the sheet. As understood from the data illustrated in FIG. 22, the stiffness of a specific type of sheet is greatly different from the stiffness of another type of sheet even if these sheets are similar in thickness.

Furthermore, as understood from the graph illustrated in FIG. 22, there is a tendency that the stiffness of a thin sheet greatly decreases if the thickness is slightly changed. Thus, according to the method for adjusting the clearance between the upper and lower guides simply based on the thickness of a sheet, it is difficult to prevent the sheet from buckling. Therefore, if the stiffness of a thick sheet is low, it is required to narrow the clearance between the upper and lower guides to prevent the sheet from buckling. However, the above-described conventional apparatus cannot prevent a thick sheet from buckling if the sheet has a lower stiffness, because the apparatus does not change the guide clearance based on the stiffness of a sheet. Moreover, as a specific mechanism for adjusting the clearance between upper and lower guides, a driving unit configured to drive a motor and a control unit configured to control the driving unit are required. Therefore, the cost for the apparatus increases.

SUMMARY OF THE INVENTION

Exemplary embodiments of the present invention are directed to a sheet conveyance apparatus capable of conveying various types of sheets different in stiffness and surely correcting the skew of each conveyed sheet without using a complicated arrangement and also capable of preventing a sheet from buckling when the sheet collides against a reference surface.

According to an aspect of the present invention, a sheet conveyance apparatus includes a reference surface extending along a sheet conveyance direction and configured to regulate the position of a side edge of a sheet to be conveyed, a skew conveyance mechanism configured to convey the sheet obliquely so that the side edge of the sheet collides against the reference surface, and a sheet deforming unit configured to deform the side edge of the sheet when the sheet is conveyed toward the reference surface by the skew conveyance mechanism.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments and features of the invention and, together with the description, serve to explain at least some of the principles of the invention.

DETAILED DESCRIPTION OF THE EMBODIMENTS

Figure 1:
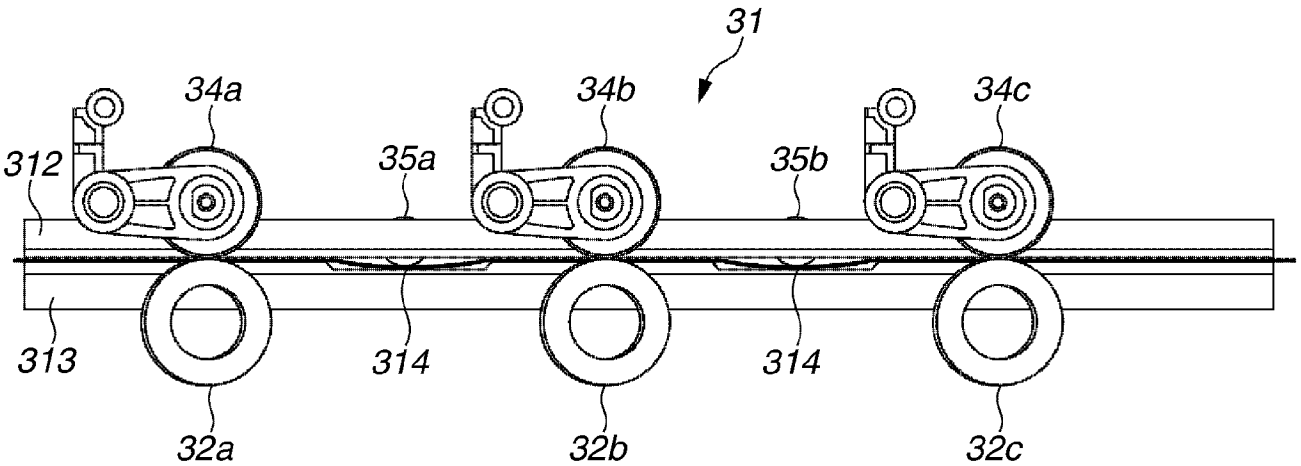
FIG. 1 illustrates a side view of an example skew correction apparatus according to an exemplary embodiment of the present invention.

The following description of exemplary embodiments is illustrative in nature and is in no way intended to limit the invention, its application, or uses. Processes, techniques, apparatus, and systems as known by one of ordinary skill in the art are intended to be part of the enabling description where appropriate. It is noted that throughout the specification, similar reference numerals and letters refer to similar items in the following figures, and thus once an item is described in one figure, it may not be discussed for following figures. Exemplary embodiments will be described in detail below with reference to the drawings.

An electrophotographic image forming apparatus 1 according to an exemplary embodiment is described below with reference to FIG. 7.

A sheet feeding apparatus 10 can store a plurality of sheets S (each serving as a transfer material) mounted on a lift-up apparatus 11. A sheet feeder unit 12 starts a sheet feeding operation in synchronization with image formation timing of an image forming mechanism 90. The sheet feeder unit 12 is, for example, a friction type that includes a feeding roller to separate a sheet or an air type that can use a suction force to hold and separate a sheet. The sheet feeder unit 12 according to the first exemplary embodiment is an air type.

The sheet S, fed from the sheet feeder unit 12, passes a conveyance path provided in a conveyance unit 20 and reaches a registration unit 30. The registration unit 30 includes a skew correction apparatus configured to perform skew correction on each sheet S and timing correction for synchronizing the sheet S with an image transfer operation performed by a secondary transfer unit. The registration unit 30 conveys the sheet S to the secondary transfer unit.

The secondary transfer unit includes an internal secondary transfer roller 43 and an external secondary transfer roller 44, which are opposed to each other to form a transfer nip portion. The secondary transfer unit can transfer a toner image (unfixed image) from an intermediate transfer belt 40 to the sheet S by applying a predetermined pressing force and an electrostatic load bias. An example image forming process for forming a toner image to be transferred to a sheet and conveying the sheet to the secondary transfer unit is described below.

Figure 7:
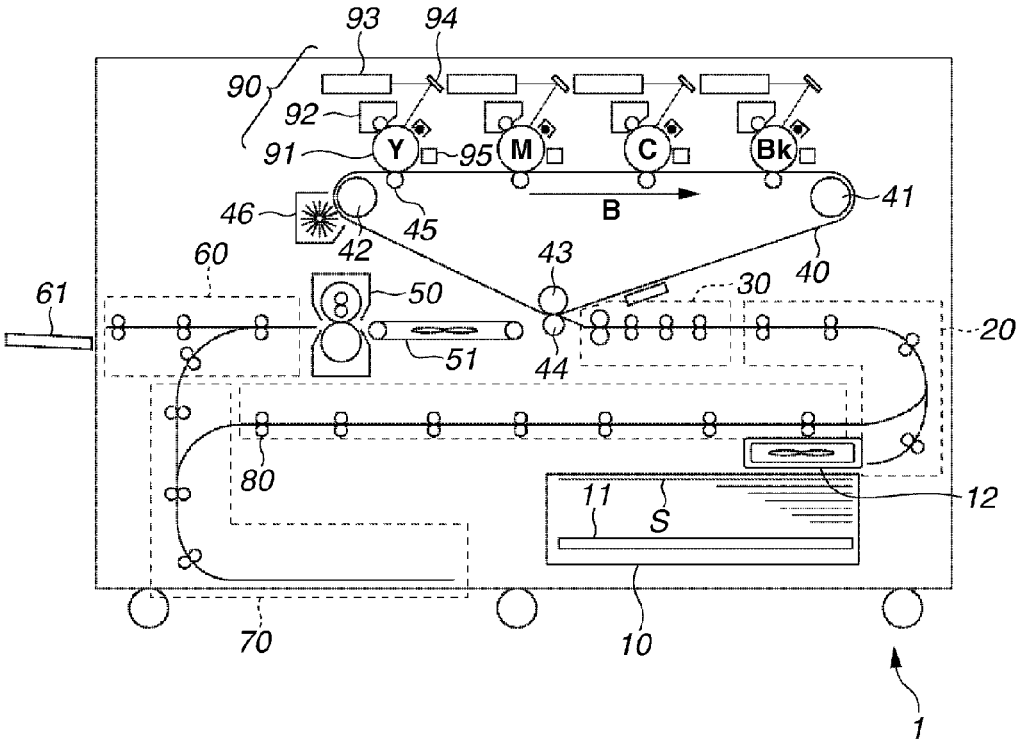
FIG. 7 illustrates a cross-sectional view of an example image forming apparatus including a skew correction apparatus according to an example embodiment of the present invention.

In FIG. 7, the image forming mechanism 90 includes photosensitive drums 91, exposure devices 93, developing units 92, primary transfer units 45, and photosensitive drum cleaners 95. Light emitted from the exposure device 93 based on an image information signal is reflected by a reflection unit 94 and reaches the photosensitive drum 91 having a surface uniformly charged beforehand by a charging unit and rotating in the counterclockwise direction. Thus, an electrostatic latent image is formed on the surface of the photosensitive drum 91. The developing unit 92 performs toner development processing, according to which an electrostatic latent image is developed as a toner image on the surface of the photosensitive drum 91 by applying a toner. Then, the primary transfer unit 45 applies a predetermined pressing force and an electrostatic load bias to transfer the toner image to the intermediate transfer belt 40. The photosensitive drum cleaner 95 collects toner particles remaining on the surface of the photosensitive drum 91.

The above-described image forming mechanism 90 includes four, i.e., yellow (Y), magenta (M), cyan (C), and black (Bk), image forming units, although the total number of colors is not limited to four and the order of color arrangement is not limited to Y→M→C→Bk.

The intermediate transfer belt 40 is stretched around a driving roller 42, a tension roller 41, and the internal secondary transfer roller 43. The intermediate transfer belt 40, when driven by a motor, rotates in a direction indicated by an arrow B. Respective color images, formed by parallel processing of the above-described Y, M, C, and Bk image forming units, are sequentially overlapped on an upstream toner image primarily transferred to the intermediate transfer belt 40. As a result, a full-color toner image is finally formed on the intermediate transfer belt 40 and conveyed to the secondary transfer unit.

Through the above-described sheet conveyance and image forming processes, the secondary transfer unit can secondarily transfer a full-color toner image on the sheet S. A belt cleaner 46 collects toner particles remaining on the surface of the intermediate transfer belt 40.

After the image is secondarily transferred to the sheet S, a pre-fixing conveyance device 51 conveys the sheet S to a fixing unit 50. The fixing unit 50 includes rollers or belts opposed to each other to apply a predetermined pressing force to the sheet S and a heat source (e.g., a halogen heater) to heat the sheet S to fuse and fix the toner on the sheet S. The sheet S with an image fixed thereon reaches a diverging conveyance device 60, which directly discharges the sheet S to a sheet discharge tray 61 or, if the apparatus performs two-sided image formation processing, conveys the sheet S to a reversing conveyance device 70.

The reversing conveyance device 70 performs a switchback operation for reversing the front/back surfaces of the sheet S and switching leading/trailing edges of the sheet S. Then, the sheet S reaches to a two-sided conveyance device 80. The two-sided conveyance device 80 causes the sheet S to enter the conveyance unit 20 while avoiding interference with another sheet S fed from the sheet feeding apparatus 10. When the sheet S reaches the secondary transfer unit again, the sheet S is subjected to image formation processing for the second page in the same manner as the above-described processing for the first page.

Figure 8A:
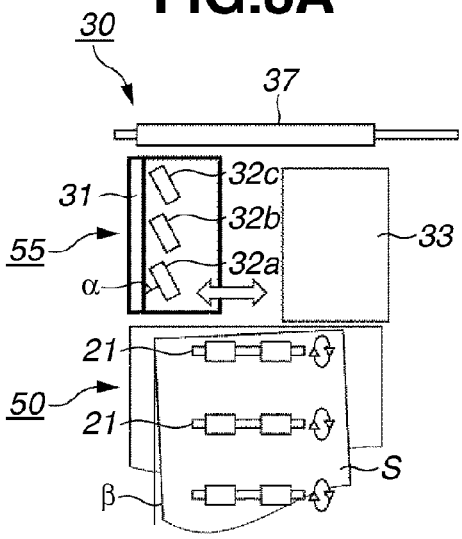
FIGS. 8A to 8D illustrate plan views of an example registration unit illustrated in FIG. 7.

The image forming mechanism 90, the intermediate transfer belt 40, the secondary transfer unit (including the internal secondary transfer roller 43 and the external secondary transfer roller 44), and the fixing unit 50 constitute an image forming unit, which is configured to form an image on a sheet according to an exemplary embodiment. FIG. 8A illustrates an example arrangement of the skew correction apparatus provided in the registration unit 30, which can correct the skew of a sheet.

The skew correction apparatus includes a movable guide 55 and a stationary guide 33. The movable guide 55 can move in a sheet width direction (i.e., in a direction perpendicular to the sheet conveyance direction) according to the size of the sheet S. The movable guide 55 includes a reference guide unit 31, a plurality of skew correction rollers 32*a*, 32*b*, and 32*c*, and pressing rollers 34*a*, 34*b*, and 34*c*, which are integrally movable. The pressing rollers 34*a*, 34*b*, and 34*c* can press the skew correction rollers 32*a*, 32*b*, and 32*c*. The stationary guide 33, which is fixed to an apparatus frame, can function as a conveyance guide for the sheet S.

Figure 2:
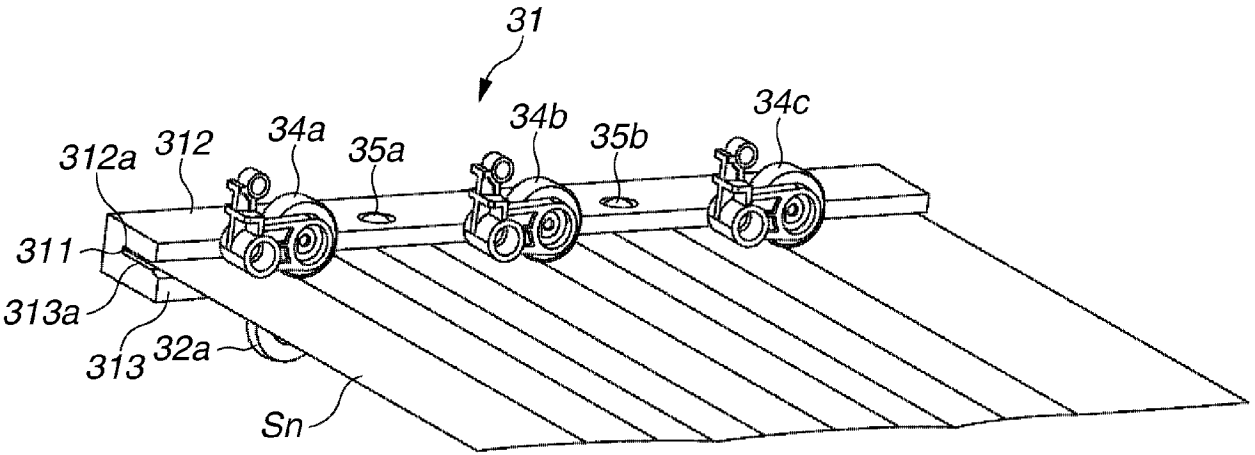
FIG. 2 illustrates a perspective view of the skew correction apparatus illustrated in FIG. 1.
Figure 3:
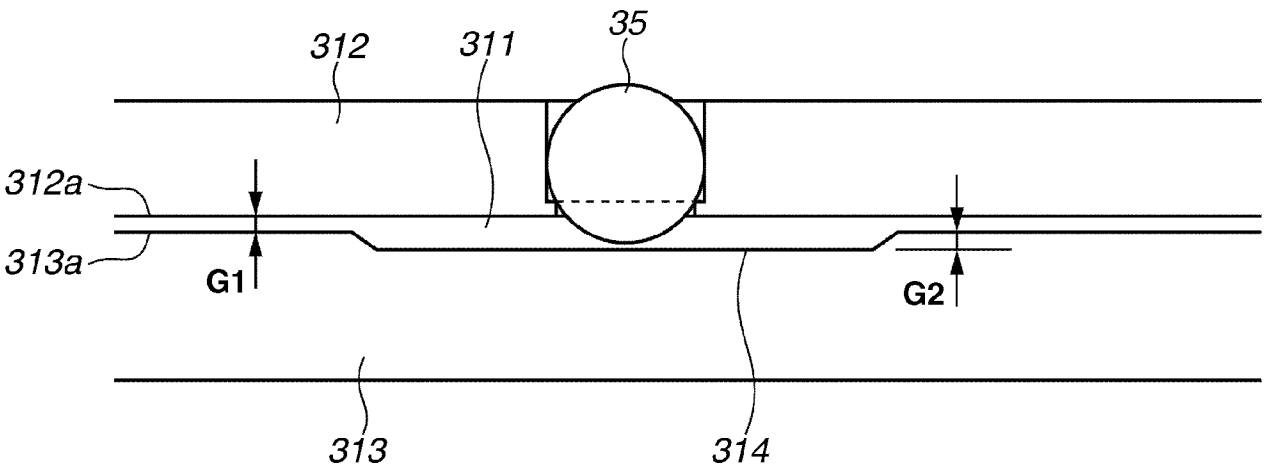
FIG. 3 illustrates an enlarged cross-sectional view of a reference guide unit illustrated in FIG. 1.
Figure 4A:
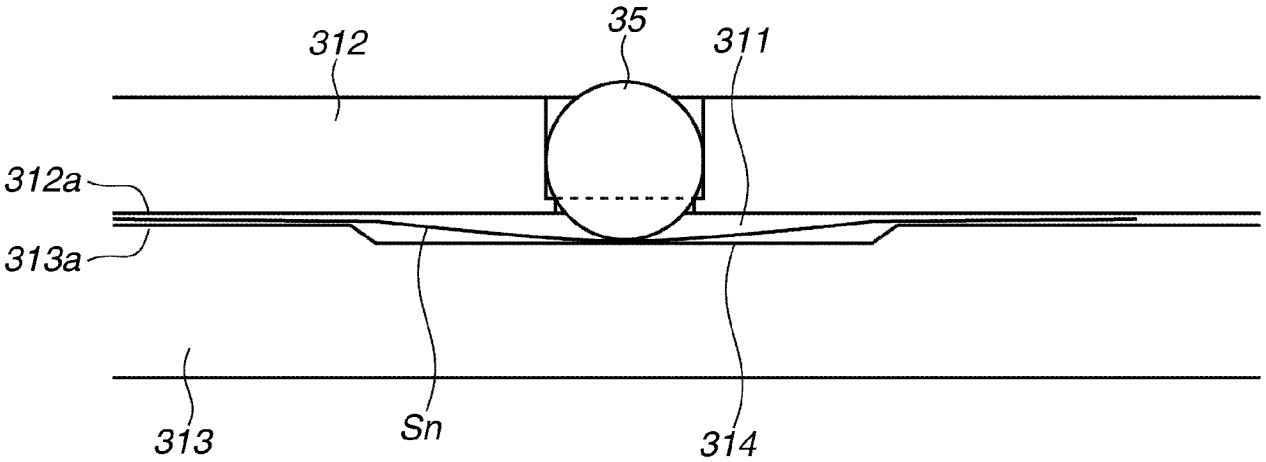
FIGS. 4A and 4B are enlarged views illustrating example operational states of the reference guide unit illustrated in FIG. 3.
Figure 4B:
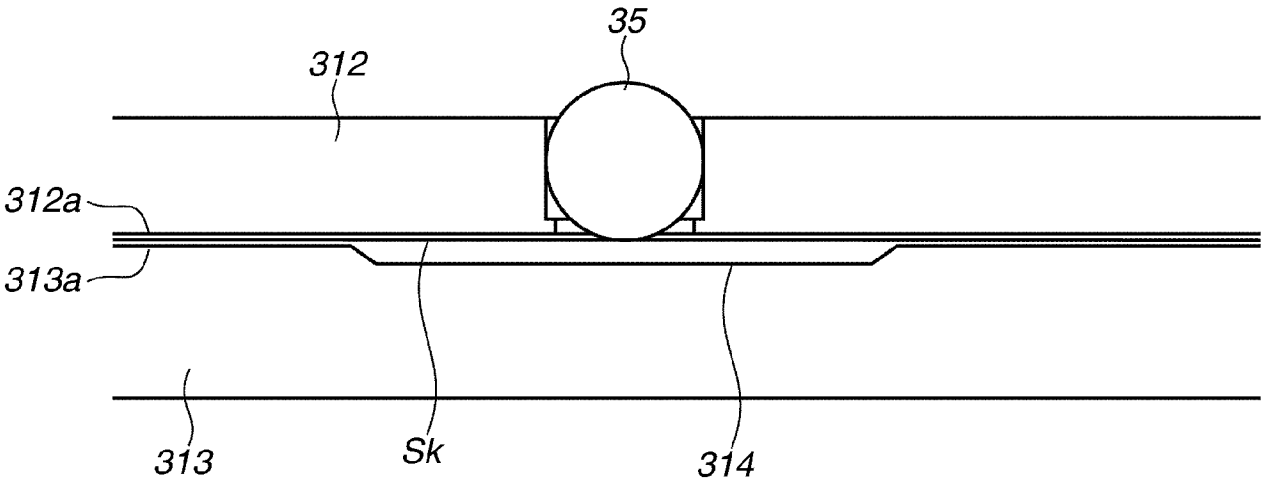
Figure 5:
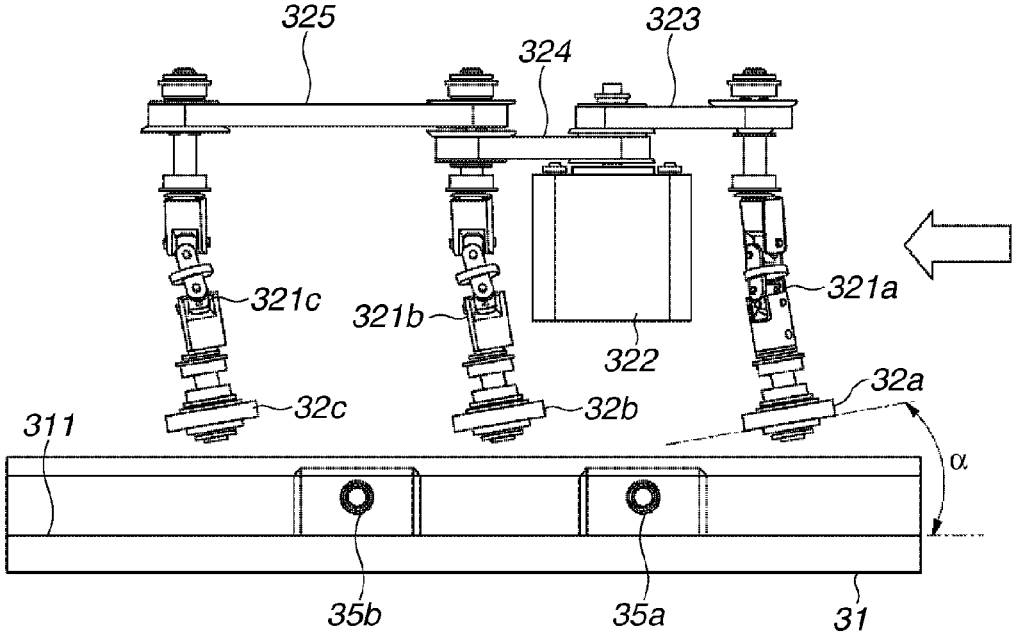
FIG. 5 illustrates a plan view of the skew correction apparatus illustrated in FIG. 1.

A detailed arrangement of the skew correction apparatus according to the first exemplary embodiment is described below with reference to FIGS. 1 to 5. FIG. 1 illustrates a side view of the skew correction apparatus as seen from a direction perpendicular to the sheet conveyance direction. FIG. 2 illustrates a perspective view of the skew correction apparatus as seen from an obliquely upper position. FIGS. 3, 4A, and 4B are partly enlarged views of FIG. 1. FIG. 5 illustrates a plan view of the skew correction apparatus illustrated in FIG. 1, which does not include an upper guide 312 of the reference guide unit 31.

As illustrated in FIGS. 1 and 2, the reference guide unit 31 of the skew correction apparatus has a grooved (U-shaped) cross section. The reference guide unit 31 includes a reference surface 311, an upper guide 312 serving as a first guide, and a lower guide 313 serving as a second guide. The reference surface 311 corrects the orientation of a sheet to eliminate a skew amount while guiding a side edge of the sheet. The reference surface 311 has a function of positioning or regulating the side edge of a sheet.

The upper guide 312 includes a sheet conveyance surface 312*a* facing one surface (the upper surface side) of a conveyed sheet. The lower guide 313 includes a sheet conveyance surface 313*a* facing the other surface (the lower surface side) of the conveyed sheet. The upper guide 312 and the lower guide 313 can cooperatively guide a side edge of a sheet to the reference surface 311 and can prevent the sheet from buckling when the sheet collides against the reference surface 311.

As illustrated in FIG. 5, the skew correction rollers 32*a*, 32*b*, and 32*c* (functioning as a skew conveyance mechanism) are inclined at an angle $\alpha$ relative to the sheet conveyance direction. The skew correction rollers 32*a*, 32*b*, and 32*c* obliquely convey a sheet toward the reference surface 311 of the reference guide unit 31 to cause the side edge of the sheet to obliquely collide against the reference surface 311. Then, the skew correction rollers 32*a*, 32*b*, and 32*c* convey the sheet while the reference surface 311 guides the side edge of the conveyed sheet.

As illustrated in FIG. 5, a driving motor 322 drives the skew correction rollers 32*a*, 32*b*, and 32*c* disposed along the sheet conveyance direction via timing belts 323, 324, and 325 and coupling joints 321*a*, 321*b*, and 321*c*. This arrangement is effective to reduce differences in driving speed among the respective skew correction rollers 32*a*, 32*b*, and 32*c*.

FIGS. 1 to 6 illustrate an example sheet deforming unit configured to bend a side edge of a sheet when the sheet collides against the reference surface 311. As illustrated in FIG. 1, the lower guide 313 has recessed portions 314 disposed at a plurality of ("two" according to the illustrated embodiment) positions along the sheet conveyance direction. The recessed portions 314 have smooth surfaces continuous to the sheet conveyance surface 313*a* of the lower guide 313. Thus, the leading edge of a conveyed sheet can easily pass the recessed portions 314.

The upper guide 312 includes spherical members 35 (35*a* and 35*b*) provided at predetermined positions, which are opposite to the recessed portions 314 provided on the lower guide 313. The spherical members 35 (35*a* and 35*b*) are protruding portions disposed on the sheet conveyance surface 312*a*. The spherical members 35 (35*a* and 35*b*) are loosely coupled in engaging holes of the upper guide 312 and supported by flange portions formed at the lower end of respective engaging holes. Each spherical member 35, when it protrudes downward from the sheet conveyance surface 312*a*, can contact a conveyed sheet at its lower part. The spherical members 35 (35*a* and 35*b*) are rotatable in any direction and can follow the change in the orientation of a sheet when the sheet collides against the reference surface 311 or when the registration roller 37 conveys the sheet. Thus, the spherical members 35 (35*a* and 35*b*) can reduce a conveyance resistance acting on a sheet.

The spherical members 35 (35*a* and 35*b*) are made of a low-frictional resin material, such as polyacetal resin (POM), which is a lightweight member capable of adequately pressing a conveyed sheet S. In an exemplary embodiment, each of the spherical members 35 has a weight of 1 g. Elastic members (e.g., springs) can be used to resiliently urge the spherical members 35 (35*a* and 35*b*) so that the spherical members 35 can surely protrude from the sheet conveyance surface 312*a*.

According to the above-described arrangement, if the stiffness of a sheet Sn is low (see FIG. 4A), the side edge of the sheet Sn deforms or bends at a portion sandwiched between the spherical member 35 and the recessed portion 314. The side edge of the sheet Sn deforms into a corrugated shape extending along the sheet conveyance direction and collides against the reference surface 311. In other words, a convex shape formed by the spherical member 35 and a concave shape formed by the corresponding recessed portion 314 can cause the side edge of a sheet to deform into a corrugated shape.

As illustrated in FIG. 4B, if the stiffness of a sheet Sk is high, the spherical members 35 (35*a* and 35*b*) are pushed upward by the sheet Sk and held at the position where the sheet Sk can contact the reference surface 311 while keeping its straight state. The moving amount of the spherical members 35 (35*a* and 35*b*) is proportional to the stiffness of a sheet. In other words, the deformation amount of a sheet is variable according to the stiffness of the sheet. The deformation amount of a sheet decreases when the stiffness of the sheet is high.

In an exemplary embodiment, a clearance G1 (i.e., a base-to-base gap illustrated in FIG. 3) between the sheet conveyance surface 312*a* of the upper guide 312 and the sheet conveyance surface 313*a* of the lower guide 313 is set to be 1 mm. The thickest sheet (a sheet having a grammage of 350 g/m$^2$) processed by an image forming apparatus according to an exemplary embodiment has a thickness of 0.4 mm. Therefore, setting of the clearance G1 is determined considering paper jam or curl occurring due to differences in the sheet thickness. An altitudinal difference G2, representing a vertical difference between the sheet conveyance surface 313*a* of the lower guide 313 and the bottom surface of the recessed portion 314 is set to be 1 mm.

In general, the buckling of a sheet occurs in proportion to a geometrical moment of inertia I. For example, if an altitudinal deformation of 2 mm is generated when a sheet having a grammage of 40 g/m$^2$ and a thickness of 0.05 mm is deformed or bent into a corrugated shape, the geometrical moment of inertia I becomes approximately 6300 times the value in a flat state. Thus, apparently that exceeds the geometrical moment of inertia I of the thickest sheet (thickness=0.4 mm).

Figure 9:
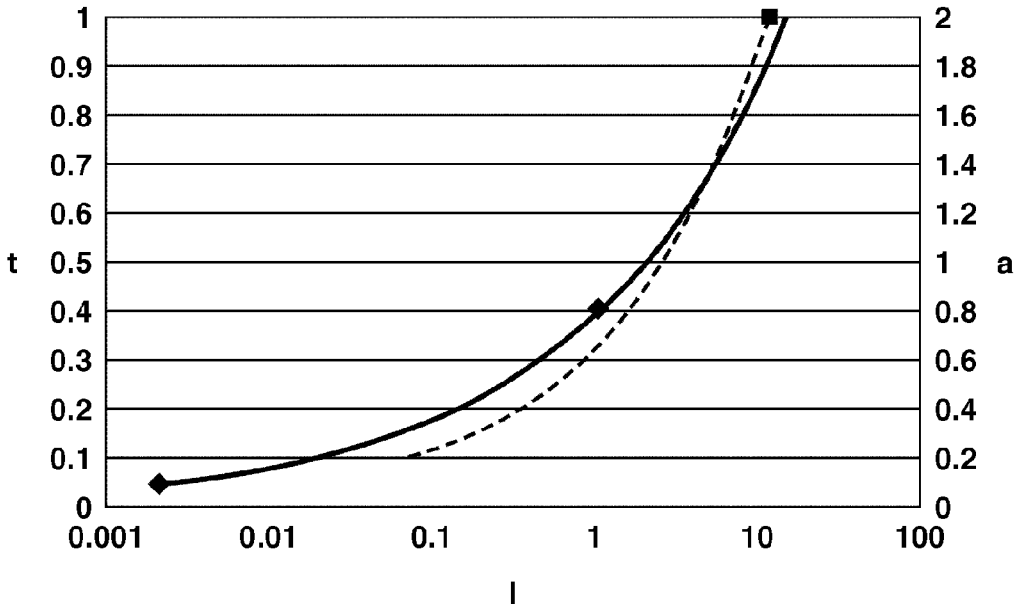
FIG. 9 is a graph illustrating an example relationship among geometrical moment of inertia, sheet thickness, and guide altitudinal difference according to an exemplary embodiment of the present invention.

FIG. 9 is a graph illustrating an example relationship between the altitudinal difference in the deformation of a sheet and the geometrical moment of inertia I. In FIG. 9, the value on the abscissa axis represents the geometrical moment of inertia I. The solid line indicates the geometrical moment of inertia I varying according to the sheet thickness "t" of plain paper. The dashed line indicates the geometrical moment of inertia I of plain paper varying according to the altitudinal difference "a" in the deformation of a sheet (thickness "t"=0.05 mm) into a corrugated shape.

As understood from the relationship illustrated in FIG. 9, the geometrical moment of inertia I can be increased to a sufficient value if the sheet is deformed appropriately. Preventing a sheet from buckling is feasible even when the stiffness of the sheet is low. Surely conveying a sheet to the reference surface without causing any jam or skew is feasible.

Accordingly, even if the stiffness of the sheet Sn is low, the stiffness (buckling force) of the sheet Sn in a direction perpendicular to the sheet conveyance direction can be enhanced, if the side edge of the sheet Sn is kept in a corrugated shape extending in the sheet conveyance direction along the reference surface 311 (FIG. 4A). Therefore, a sheet having a lower stiffness does not buckle when it collides against the reference surface 311.

The deformation amount of a sheet (altitudinal difference in the deformation of a corrugated shape) is variable according to the stiffness of a sheet. When the stiffness of a sheet is high, the deformation amount is small and the conveyance resistance is small. Therefore, a sheet having a lower stiffness causes a large deformation. The deformed portion enhances the stiffness of the sheet and prevents the sheet from buckling. A sheet having a higher stiffness causes a small deformation and a small conveyance frictional force. Thus, the apparatus can smoothly convey the sheet. Therefore, the apparatus can accurately perform the skew correction.

The spherical members 35*a* and 35*b* are disposed at predetermined positions along the sheet conveyance direction, which correspond to midpoints between the skew correction rollers 32*a* and 32*b* and between the skew correction rollers 32*b* and 32*c*, respectively. Therefore, the spherical members 35*a* and 35*b* can stably cause a sheet having a lower stiffness to deform into a corrugated shape. In other words, the side edge of a sheet symmetrically deforms between two neighboring skew correction rollers. Thus, the apparatus can stably convey a sheet while the sheet holds a deformed state.

If the skew correction roller disposed on the downstream side has a higher conveyance speed compared to that of the skew correction roller disposed on the upstream side, the corrugated shape of a sheet may collapse or disappear because the sheet is pulled by the downstream skew correction roller and a significant tensile stress acts on the sheet. As a result, the effect of enhancing the stiffness of a sheet is lessened.

Figure 6:
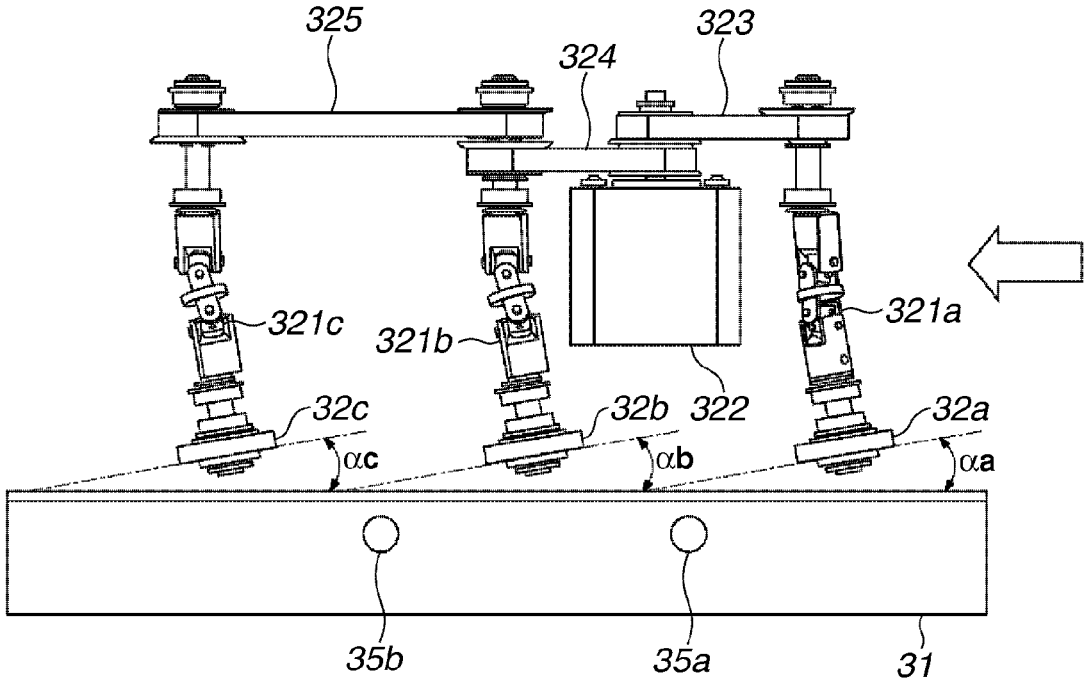
FIG. 6 illustrates a plan view of the skew correction apparatus illustrated in FIG. 1.

Therefore, as illustrated in FIG. 6, the skew correction rollers 32*a*, 32*b*, and 32*c* according to an exemplary embodiment are set to have different skew angles $\alpha a$, $\alpha b$, and $\alpha c$, respectively. The skew correction roller disposed on the downstream side has a larger skew angle compared to that of the skew correction roller disposed on the upstream side ($\alpha c > \alpha b > \alpha a$). Accordingly, the skew correction roller disposed on the downstream side has a smaller speed component along the sheet conveyance direction compared to that of the skew correction roller disposed on the upstream side. It is desired to determine the skew angles of respective skew correction rollers 32*a*, 32*b*, and 32*c* considering the tolerance in outer diameter, to ensure the above-described speed component relationship along the sheet conveyance direction.

In an exemplary embodiment, the sheet conveyance angles (skew angles) of respective skew correction rollers 32*a*, 32*b*, and 32*c* are set to satisfy the above-described relationship. Thus, the skew correction roller disposed on the downstream side has a smaller speed component along the sheet conveyance direction compared to that of the skew correction roller disposed on the upstream side. However, the present invention is not limited to the above-described embodiment.

For example, in another exemplary embodiment, the skew correction roller disposed on the downstream side has a smaller outer diameter compared to that of the skew correction roller disposed on the upstream side. In another exemplary embodiment, driving motors independently drive the skew correction rollers 32*a*, 32*b*, and 32*c*. The conveyance speed of the downstream skew correction roller is set to be slower than that of the upstream skew correction roller.

To prevent a sheet having a lower stiffness from buckling, it is desired to locate the spherical members 35*a* and 35*b* close to the reference surface 311. Therefore, in an exemplary embodiment, the spherical members 35*a* and 35*b* are disposed on the upper guide 312. However, the spherical members 35*a* and 35*b* can be disposed anywhere between the skew correction rollers 32*a*, 32*b*, and 32*c* and the reference surface 311. Therefore, setup positions of the spherical members 35*a* and 35*b* can be adequately determined considering the materials to be supported and the arrangement of the apparatus. The number of the skew correction rollers, the recessed portions, and the spherical members can be increased or decreased according to the materials to be supported and the arrangement of the apparatus.

Figure 8B:
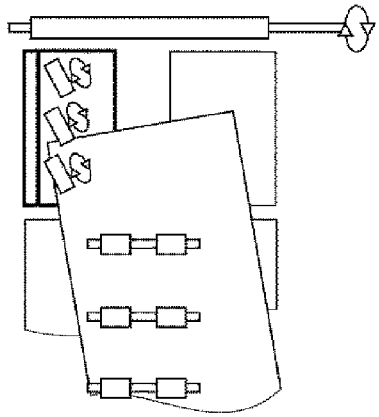

FIGS. 8A to 8D illustrate an example sheet alignment operation performed by the registration unit 30. First, as illustrated in FIG. 8A, the skew correction apparatus receives a sheet S inclined at an angle β. Sheet conveyance rollers 21 convey the sheet S to the skew correction rollers 32*a*, 32*b*, and 32*c*. The skew correction rollers 32*a*, 32*b*, and 32*c* obliquely convey the sheet S toward the reference guide unit 31 as illustrated in FIG. 8B.

Figure 8C:
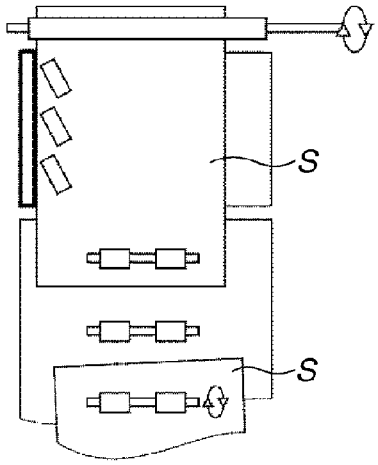

In this case, an actuator (not illustrated) causes the sheet conveyance rollers 21 to release a nipping force applied on the sheet S before the skew correction roller 32*a* starts conveying the sheet S. Then, as illustrated in FIG. 8C, the side edge of the sheet S collides against the reference surface 311 of the reference guide unit 31 and rotates (changes its orientation) to eliminate a skew amount. The sheet S moves straight to the registration roller 37, while the reference surface 311 regulates the position of the sheet S in a direction perpendicular to the sheet conveyance direction.

Figure 8D:
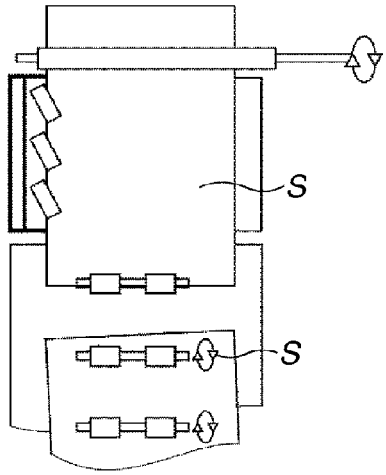

When the sheet S reaches the registration roller 37, the sheet S is held in a nipped state. An actuator (not illustrated) causes the pressing rollers 34*a*, 34*b*, and 34*c* opposed to the skew correction rollers 32*a*, 32*b*, and 32*c* to release a nipping force applied on the sheet S. Then, the registration roller 37 slides in a direction perpendicular to the sheet conveyance direction in a state where the registration roller 37 nips the sheet S, as illustrated in FIG. 8D.

The registration roller 37 has a function of adjusting the position of the sheet S so as to match an image on the intermediate transfer belt 40. In this case, the reference guide unit 31 regulates the position of the side edge of a sheet. Therefore, the apparatus causes the registration roller 37 to move along a direction perpendicular to the sheet conveyance direction with reference to a distance from the reference guide unit 31. Then, the registration roller 37 conveys the sheet S to the secondary transfer unit.

Figure 10:
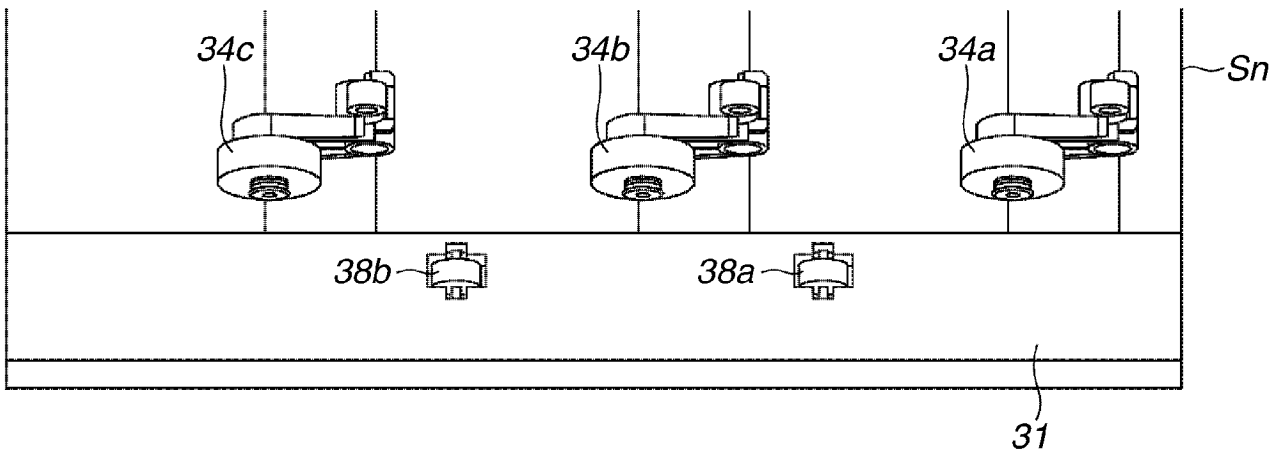
FIG. 10 is a perspective view illustrating an example skew correction apparatus according to a second exemplary embodiment of the present invention.

FIG. 10 illustrates a skew correction apparatus according to a second exemplary embodiment of the present invention, as seen from an obliquely upward position. The skew correction apparatus illustrated in FIG. 10 is similar to the skew correction apparatus according to the first exemplary embodiment, except that the second exemplary embodiment replaces the spherical members 35*a* and 35*b* serving as protruding portions with columnar rollers 38*a* and 38*b*.

The columnar rollers 38*a* and 38*b* are loosely coupled in engaging holes provided on the upper guide 312. The columnar rollers 38*a* and 38*b* can protrude from the sheet conveyance surface 312*a* of the upper guide 312. Rotational shafts of the columnar rollers 38*a* and 38*b* are supported by grooves (slits) formed on walls of the engaging holes. The columnar rollers 38*a* and 38*b* can rotate in the sheet conveyance direction and can move in the up-and-down direction.

Similar to the spherical members 35*a* and 35*b*, the columnar rollers 38*a* and 38*b* have a function of deforming the side edge of a sheet having a lower stiffness when the sheet is present between the columnar rollers 38*a* and 38*b* and the recessed portions 314. The deformed side edge of a sheet enhances the stiffness of the sheet. The apparatus can surely perform skew correction. If a conveyed sheet has a higher stiffness, the sheet pushes the columnar rollers 38*a* and 38*b* and moves them upward. Thus, the skew correction apparatus according to the second exemplary embodiment can perform skew correction similar to that performed by the skew correction apparatus according to the first exemplary embodiment.

Compared to the arrangement required for supporting the rotary spherical members 35*a* and 35*b*, the arrangement required for supporting the rotational shafts of the columnar rollers 38*a* and 38*b* with the grooves (slits) is simple. Manufacturing of the columnar rollers 38*a* and 38*b* does not require high accuracy. Therefore, the manufacturing cost for the columnar rollers 38*a* and 38*b* is low.

Figure 11:
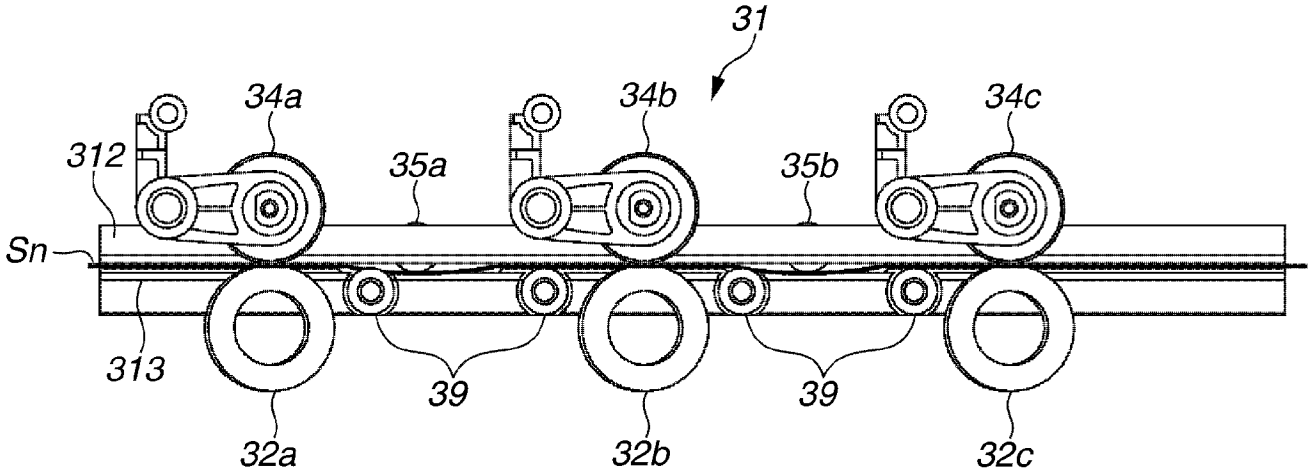
FIG. 11 illustrates a side view of an example skew correction apparatus according to a third exemplary embodiment of the present invention.

FIG. 11 illustrates an example skew correction apparatus according to a third exemplary embodiment of the present invention. Compared to the first exemplary embodiment, the skew correction apparatus illustrated in FIG. 11 includes a plurality of lower guide rollers 39 protruding from the sheet conveyance surface 313*a* of the lower guide 313 and does not include the recessed portions 314 on the sheet conveyance surface 313*a* of the lower guide 313. The lower guide rollers 39 are rotatable in the sheet conveyance direction. The rest of the arrangement is similar to the arrangement described in the first exemplary embodiment.

In the third exemplary embodiment, two lower guide rollers 39 are positioned on the upstream side and the downstream side of each spherical member 35 (35*a* or 35*b*) along the sheet conveyance direction. In other words, a pair of lower guide rollers 39 forms a substantially recessed portion on the sheet conveyance surface 313*a* of the lower guide 313. The lower guide rollers 39 and the spherical members 35*a* and 35*b* are disposed in a staggered pattern as seen from the side. Therefore, a convex shape formed by the spherical member 35 (35*a* or 35*b*) and a concave shape formed by a pair of lower guide rollers 39 can cause the side edge of a sheet to deform into a corrugated shape.

Thus, if a sheet subjected to the skew correction has a lower stiffness, the side edge of the sheet is deformed into a corrugated shape between the lower guide rollers 39 and the spherical members 35*a* and 35*b*, while the reference surface 311 regulates the position of the sheet in a direction perpendicular to the sheet conveyance direction. Therefore, the apparatus can perform the skew correction on a conveyed sheet while preventing the sheet from buckling.

In the skew correction apparatus according to the third exemplary embodiment, the lower guide rollers 39 and the spherical members 35*a* and 35*b* can smoothly rotate in the sheet conveyance direction when a conveyed sheet passes between them. Therefore, the skew correction apparatus according to the third exemplary embodiment can reduce the frictional force acting on a sheet and can accurately perform the skew correction.

Figure 12:
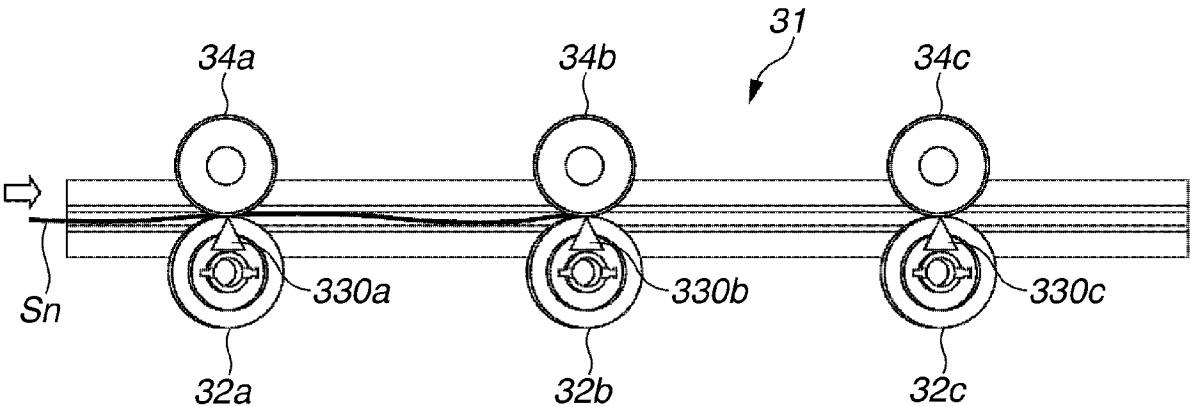
FIG. 12 illustrates a side view of an example skew correction apparatus according to a fourth exemplary embodiment of the present invention.

FIG. 12 illustrates an example skew correction apparatus according to a fourth exemplary embodiment of the present invention. The skew correction apparatus illustrated in FIG. 12 can control the sheet conveyance speed of each skew correction roller to deform the side edge of a sheet into a corrugated shape with the reference guide unit 31 including no corrugated configuration. The rest of the arrangement is similar to the arrangement described in the first exemplary embodiment.

Driving motors M1, M2, and M3 (FIG. 13), serving as driving sources for the skew correction rollers 32*a*, 32*b*, and 32*c*, are controlled to independently rotate the skew correction rollers 32*a*, 32*b*, and 32*c*. Sheet detection sensors 330*a*, 330*b*, and 330*c*, which are capable of detecting a conveyed sheet, are disposed near nip portions of the skew correction rollers 32*a*, 32*b*, and 32*c*.

Figure 13:
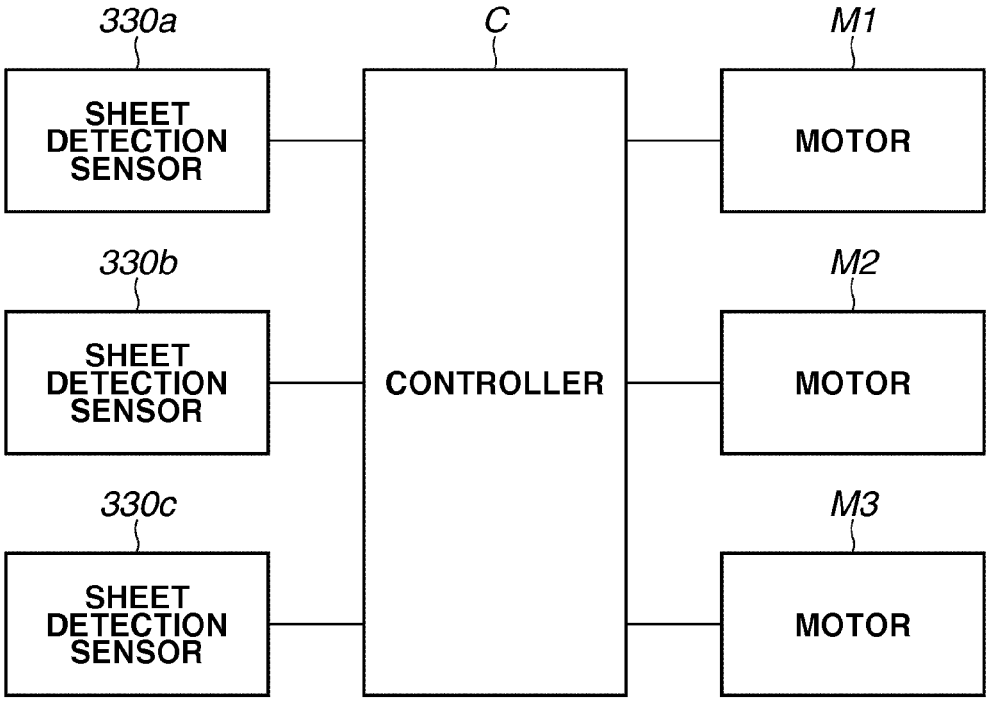
FIG. 13 is a block diagram of an example control system according to the fourth exemplary embodiment of the present invention.

As illustrated in a control block diagram of FIG. 13, a controller C is connected to the driving motors M1, M2, and M3 (driving sources) respectively driving the skew correction rollers 32*a*, 32*b*, and 32*c*. The controller C sends control signals to the driving motors M1, M2, and M3. The controller C receives signals from the sheet detection sensors 330*a*, 330*b*, and 330*c*, which can respectively detect a sheet conveyed to the skew correction rollers 32*a*, 32*b*, and 32*c*.

With the above-described arrangement, the controller C can detect a sheet, when the sheet reaches the nip portions of the skew correction rollers 32*a*, 32*b*, and 32*c*, based on detection signals from the sheet detection sensors 330*a*, 330*b*, and 330*c*. The controller C sequentially controls the driving motors M1, M2, and M3 to start rotating based on detections by these sensors. Accordingly, the skew correction rollers 32*a*, 32*b*, and 32*c* sequentially start rotating.

Figure 14:
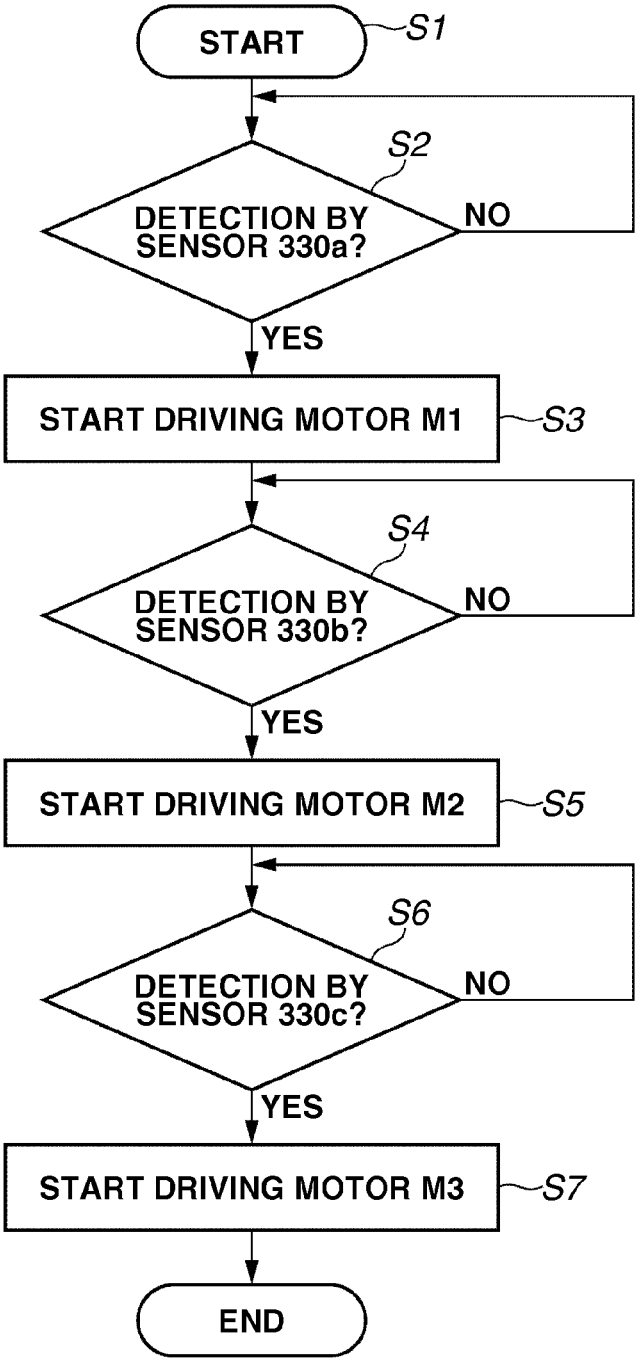
FIG. 14 is a flowchart illustrating an example operation performed by the control system illustrated in FIG. 13.

FIG. 14 is a flowchart illustrating example processing performed by the controller C.

In step S1, the controller C starts skew correction control. In step S2, the controller C determines whether a sheet has been detected by the sheet detection sensor 330*a*. If a sheet has been detected by the sheet detection sensor 330*a* (YES in step S2), the processing proceeds to step S3.

In step S3, the controller C causes the driving motor M1 to start rotating. The sheet is continuously conveyed by the skew correction roller 32*a*, which is driven by the driving motor M1.

In step S4, the controller C determines whether the sheet conveyed by the skew correction roller 32*a* has been detected by the sheet detection sensor 330*b*. If the sheet has been detected by the sheet detection sensor 330*b* (YES in step S4), the processing proceeds to step S5. In step S5, the controller C causes the driving motor M2 to start rotating. The sheet is continuously conveyed by the correction roller 32*b*, which is driven by the driving motor M2. In this case, there is a time difference between the timing when the sheet is detected by the sheet detection sensor 330*b* and the timing when the driving motor M2 starts rotating to convey the sheet. Therefore, the sheet is temporarily slowed down or temporarily stopped.

In step S6, the controller C determines whether the sheet conveyed by the skew correction roller 32*b* has been detected by the sheet detection sensor 330*c*. If the sheet has been detected by the sheet detection sensor 330*c* (YES in step S6), the processing proceeds to step S7. In step S7, the controller C causes the driving motor M3 to start rotating. The sheet is continuously conveyed by the correction roller 32*c*, which is driven by the driving motor M3. In this case, there is a time difference between the timing when the sheet detection sensor 330*c* detects a sheet and the timing when the driving motor M3 starts rotating to convey the sheet.

Therefore, the sheet is temporarily slowed down or temporarily stopped. While the skew correction rollers 32*a*, 32*b*, and 32*c* sequentially start rotating, the sheet is obliquely conveyed to cause the side edge of the sheet to collide against the reference surface 311, thus eliminating a skew amount of the sheet.

As described above, there is a time lag when each of the skew correction rollers 32*a*, 32*b*, and 32*c* starts rotating. Thus, the timing when the driving motor starts rotating is delayed compared to the timing when the sheet is detected by the sheet detection sensor. Therefore, a conveyed sheet is slowed down when the sheet is nipped by the skew correction roller or stopped before the sheet is nipped by the skew correction roller.

Accordingly, a sheet having a lower stiffness is deformed into a corrugated shape at its side edge, while the sheet is decelerated or stopped temporarily between the skew correction rollers 32*a*, 32*b*, and 32*c*. The corrugated side edge enhances the stiffness of the sheet. Therefore, even if a sheet has a low stiffness, the apparatus can surely perform the skew correction on a conveyed sheet without causing any buckling when the sheet collides against the reference surface 311.

On the other hand, if a conveyed sheet has a high stiffness (e.g., a thick sheet), the sheet can slide at a nip portion of the roller without causing any deformation. In an example embodiment, the sheet detection sensors 330*a*, 330*b*, and 330*c* can be disposed on the upstream side of the corresponding skew correction rollers 32*a*, 32*b*, and 32*c*.

Each skew correction roller can be controlled to start rotating based on a measurement by a timer configured to measure a predetermined time after each sensor detects a sheet. In this case, the apparatus can deform a conveyed sheet by delaying the timing when the skew correction roller starts rotating, compared to a time required for the sheet to reach the skew correction roller after detection of the sheet by the sensor. By repeating the above-described operation successively, the apparatus can deform the side edge of the sheet into a corrugated shape.

As another method for deforming the side edge of a sheet into a corrugated shape, circumferential speeds of the respective skew correction rollers 32*a*, 32*b*, and 32*c* can be controlled so that the skew correction roller disposed on the downstream side is slower in circumferential speed than the skew correction roller disposed on the upstream side.

In this manner, the apparatus can deform the side edge of a sheet into a corrugated shape by controlling the rotation of each skew correction roller. The apparatus can surely perform the skew correction. As described above, the apparatus can form a corrugated shape by controlling only the rotational speed of each skew correction roller. Thus, compared to an apparatus using rollers, the apparatus according to the present embodiment can eliminate occurrence of paper jam.

Figure 15:
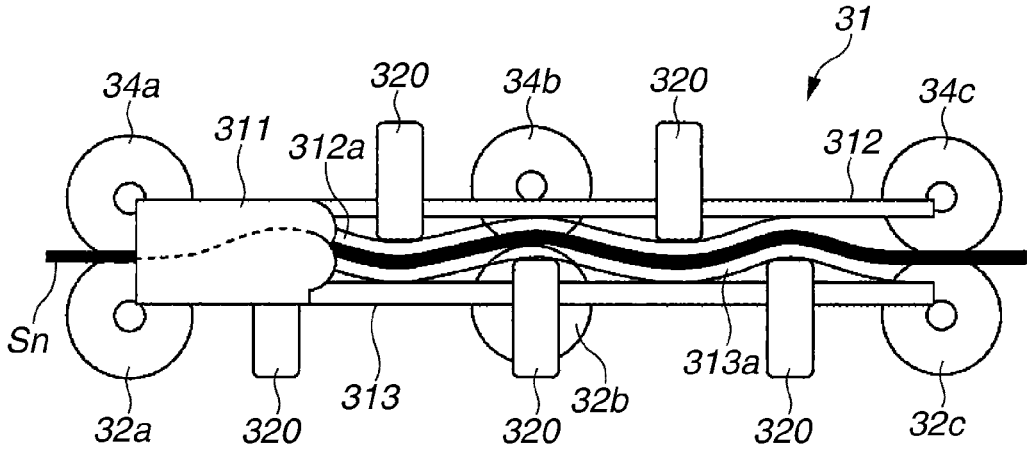
FIG. 15 illustrates a front view of an example skew correction apparatus according to a fifth exemplary embodiment of the present invention.
Figure 16:
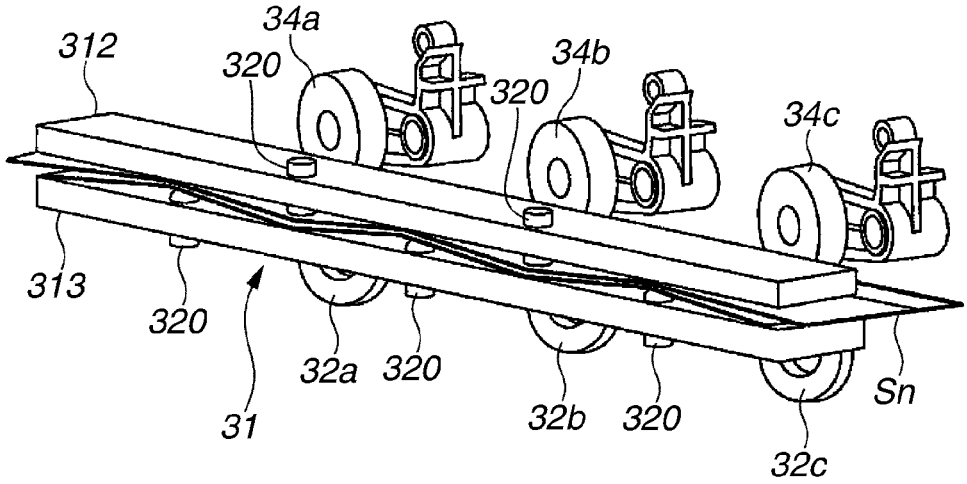
FIG. 16 illustrates a perspective view of the skew correction apparatus illustrated in FIG. 15.
Figure 17:
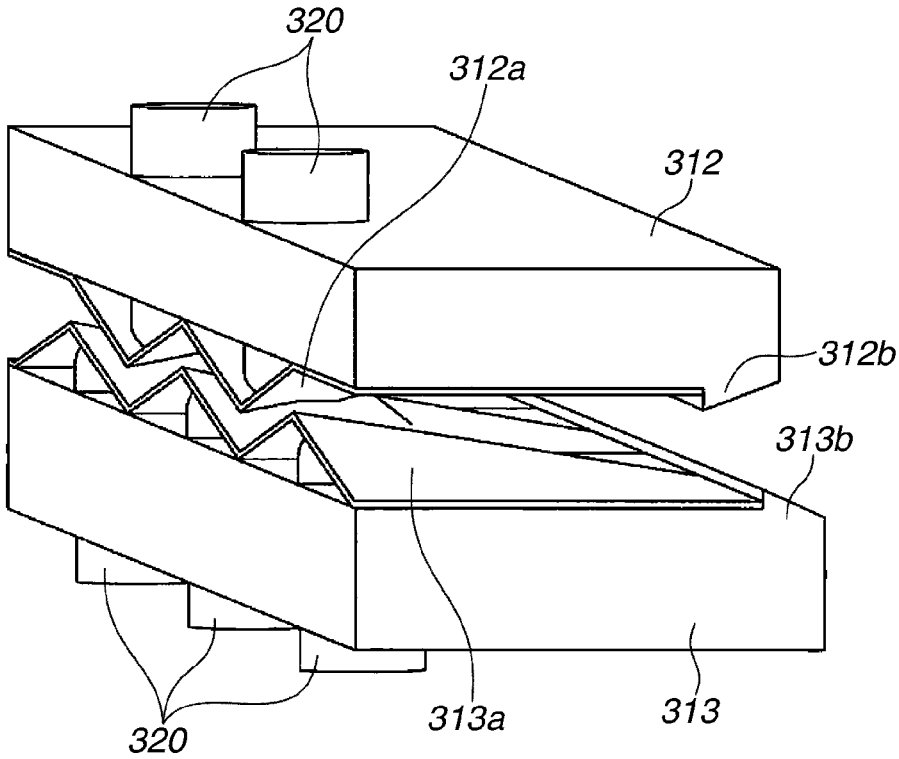
FIG. 17 illustrates an enlarged perspective view of the skew correction apparatus illustrated in FIG. 16.

FIG. 15 is a cross-sectional view illustrating a skew correction apparatus including a bending unit configured to deform the side edge of a paper extending along a direction parallel to the sheet conveyance direction according to a fifth exemplary embodiment of the present invention, although the reference surface 311 of the reference guide unit 31 is partly cut. FIG. 16 is a perspective view illustrating the skew correction apparatus as seen from an obliquely upward position. FIG. 17 is a perspective view illustrating an enlarged arrangement of the skew correction apparatus illustrated in FIG. 16. In FIGS. 16 and 17, the reference surface 311 is removed to explicitly illustrate a state of the sheet.

Figure 23A:
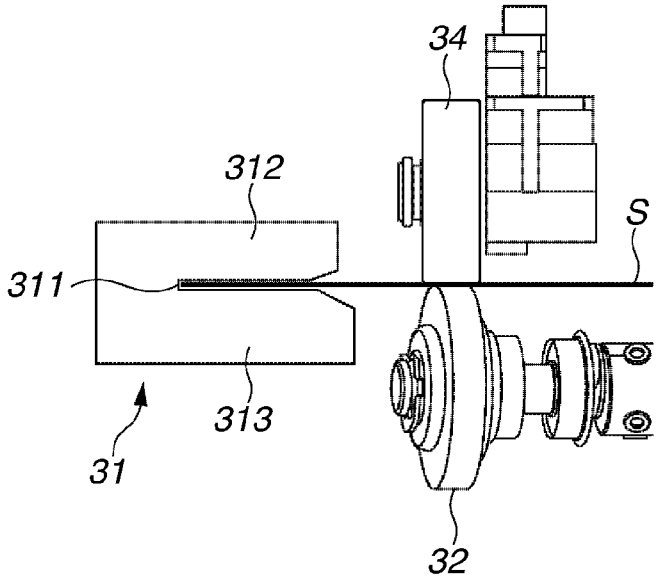
FIG.23A PRIOR ART
FIGS. 23A and 23B illustrate a conventional skew correction apparatus as seen from a sheet conveyance direction.
Figure 23B:
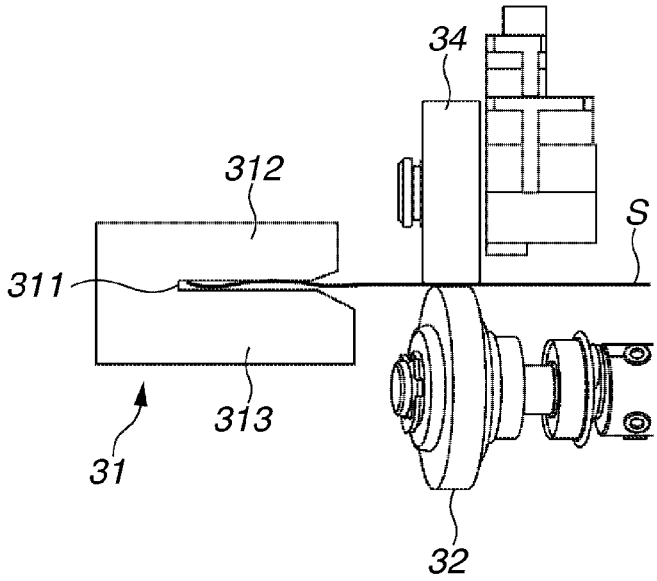
FIG.23B PRIOR ART

The reference guide unit 31 according to the fifth exemplary embodiment of the present invention has a U-shaped cross section similar to that described with reference to FIGS. 23A and 23B. The reference guide unit 31 includes the reference surface 311 (partly illustrated in FIG. 15) defining an inner wall, the upper guide 312, and the lower guide 313 (i.e., a pair of guide members), which cooperatively form a U-shaped sheet guide surface.

As illustrated in FIG. 17, to guide a conveyed sheet, flexible sheet-like guide members 312*a* and 313*a* are provided on a lower surface of the upper guide 312 and an upper surface of the lower guide 313, respectively. The flexible sheet-like guide members 312*a* and 313*a* are made of an expandable material having a lower frictional coefficient comparable to that of the guide surfaces of the upper guide 312 and the lower guide 313. The upper guide 312 and the lower guide 313 have distal ends (open ends) configured into slant guides 312*b* and 313*b* capable of guiding a sheet inserted into the clearance between the upper guide 312 and the lower guide 313. As illustrated in FIG. 17, the edge portions of the sheet-like guide members 312*a* and 313*a*, positioned on the slant guides 312*b* and 313*b* side, are lower than the peaks of the slant guides 312*b* and 313*b*, respectively.

The upper guide 312 and the lower guide 313 include a plurality of projecting members 320 disposed along the sheet conveyance direction. Each projecting member 320 can protrude from the guide surface. In an exemplary embodiment, two projecting members 320 are present on the upper guide 312 and three projecting members 320 are present on the lower guide 313. As illustrated in FIG. 15, the projecting members 320 are disposed at constant intervals on each of the upper guide 312 and the lower guide 313. The projecting members 320 are alternately disposed on the upper guide 312 and the lower guide 313.

The position where the sheet-like guide member 312*a* deforms in a convex shape is opposed to the position where the sheet-like guide member 313*a* deforms in a concave shape along the sheet conveyance direction. The position where the sheet-like guide member 312*a* deforms in a concave shape is opposed to the position where the sheet-like guide member 313*a* deforms in a convex shape along the sheet conveyance direction.

The interval of the projecting members 320 in the conveyance direction is set to be approximately 40 mm. An actuator (not illustrated) can drive each projecting member 320. The projecting member 320 can move in the up-and-down direction by a predetermined amount.

In an operation for conveying a thick paper (hereinafter referred to as a "thick paper passing operation"), the apparatus sets the protruding amount of the projecting members 320 from the lower surface of the upper guide 312 to be 0 mm. Furthermore, the apparatus sets the protruding amount of the projecting members 320 from the upper surface of the lower guide 313 to be 0 mm. In other words, the apparatus positions the protruding ends of the sheet-like guide members 312*a* and 313*a* at the same height as the guide surfaces of the upper guide 312 and the lower guide 313. The sheet-like guide members 312*a* and 313*a* are flat in this case.

The upper sheet-like guide member 312*a* is fixed to the upper guide 312 at a position where a corresponding projecting member 320 is provided on the lower guide 313. Similarly, the lower sheet-like guide member 313*a* is fixed to the lower guide 313 at a position where a corresponding projecting member 320 is provided on the upper guide 312.

Figure 18A:
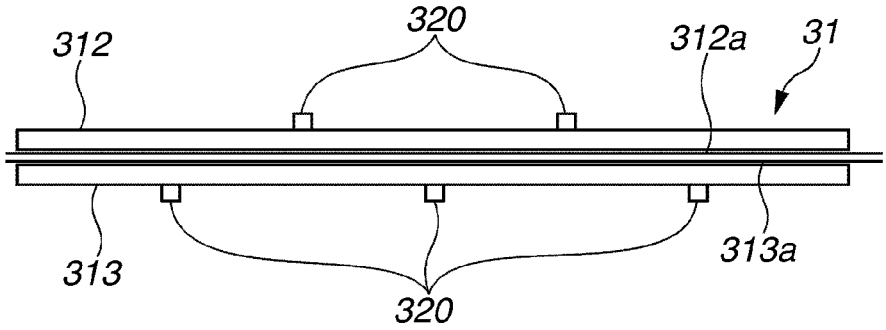
FIG. 18A is a front view illustrating an example state when a thick paper is passing through the skew correction apparatus illustrated in FIG. 15.
Figure 18B:
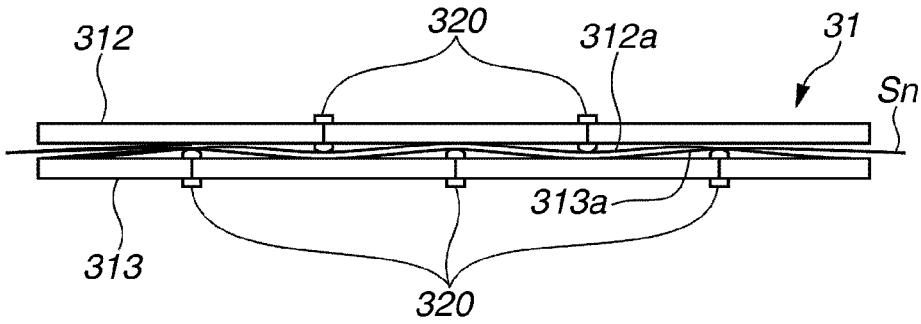
FIG. 18B is a front view illustrating an example state when a thin paper is passing through the skew correction apparatus illustrated in FIG. 15.

FIGS. 15, 18A, and 18B are front views of the reference guide unit 31 as seen from a direction perpendicular to the sheet conveyance direction. FIG. 18A illustrates an example state of the reference guide unit 31 in a thick paper passing operation. FIGS. 15 and 18B illustrate example states of the reference guide unit 31 when a thin paper is conveyed (hereinafter referred to as a "thin paper passing operation").

As illustrated in FIG. 18A, the projecting members 320 do not protrude from the guide surfaces when the skew correction is performed on a sheet having a higher rigidity or stiffness and robust against buckling, such as plain paper or thick paper. Therefore, the apparatus can convey the sheet in a straight state with a smaller conveyance resistance while suppressing troubles in conveyance.

As illustrated in FIGS. 15 and 18B, when the apparatus performs the skew correction on a sheet having a lower rigidity or stiffness, the apparatus sets the protruding amount of the projecting members 320 from the guide surfaces of the upper guide 312 and the lower guide 313 to be approximately 3 mm. A user can change the protruding amount.

When the projecting members 320 protrude from the guide surfaces of the upper guide 312 and the lower guide 313, the sheet-like guide members 312*a* and 313*a* maintain a corrugated shape as illustrated in FIGS. 15 and 18B. In this state, if a sheet having a lower rigidity or stiffness passes through the clearance between the guide members 312*a* and 313*a*, the sheet deforms into a corrugated shape corresponding to the sheet-like guide members 312*a* and 313*a*. Thus, the apparatus can enhance the rigidity of a sheet while conveying it.

Figure 19:
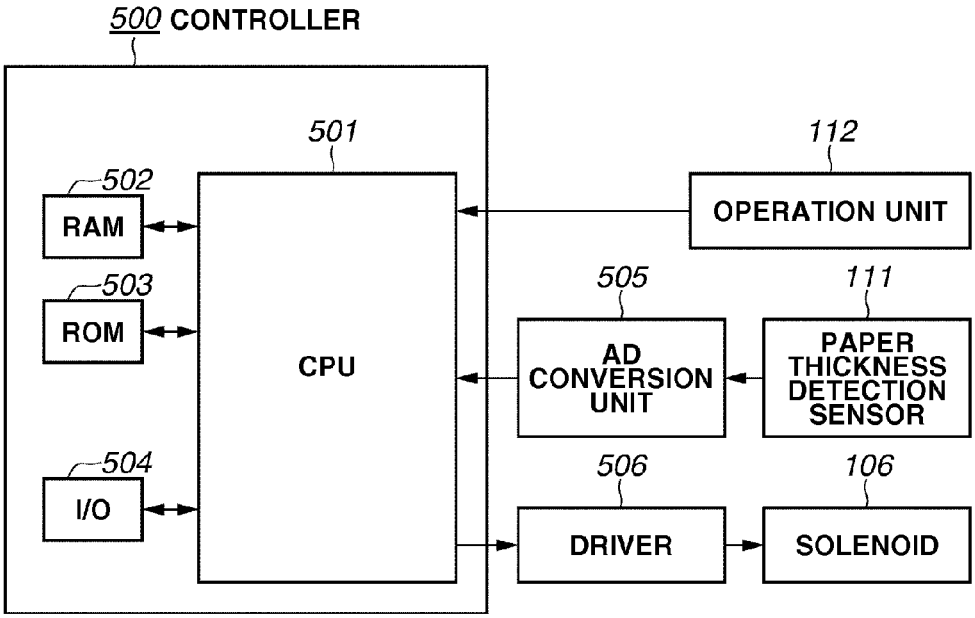
FIG. 19 is a block diagram illustrating an example control unit for controlling the skew correction apparatus illustrated in FIG. 15.

FIG. 19 is a block diagram illustrating an example control unit according to an exemplary embodiment. A controller 500 includes a central processing unit (CPU) 501, a read only memory (ROM) 503 capable of storing programs, a random access memory (RAM) 502 capable of temporarily storing data, and an input/output (I/O) interface 504 operable as a communication interface. The controller 500 receives paper thickness information of the sheet S entered by a user via an operation unit 112 or a detection signal from a paper thickness detection sensor 111 (i.e., a signal recognizing the thickness of the sheet S) via an analog/digital (AD) conversion unit 505. The controller 500 activates a solenoid 106 via a driver 506 to drive the projecting members 320 based on the received paper thickness information.

For example, if the sheet S is thick paper, the controller 500 deactivates the solenoid 106. In this case, the sheet-like guide member 312*a* and the sheet-like guide member 313*a* are flat guide surfaces not protruding in the up-and-down direction from the upper guide 312 and the lower guide 313. If the sheet S is a thin paper, the controller 500 activates the solenoid 106 to cause the sheet-like guide members 312*a* and 313*a* to form corrugated guide surfaces. Although not described in detail, the controller 500 performs other control operations for the image forming apparatus.

Figure 20:
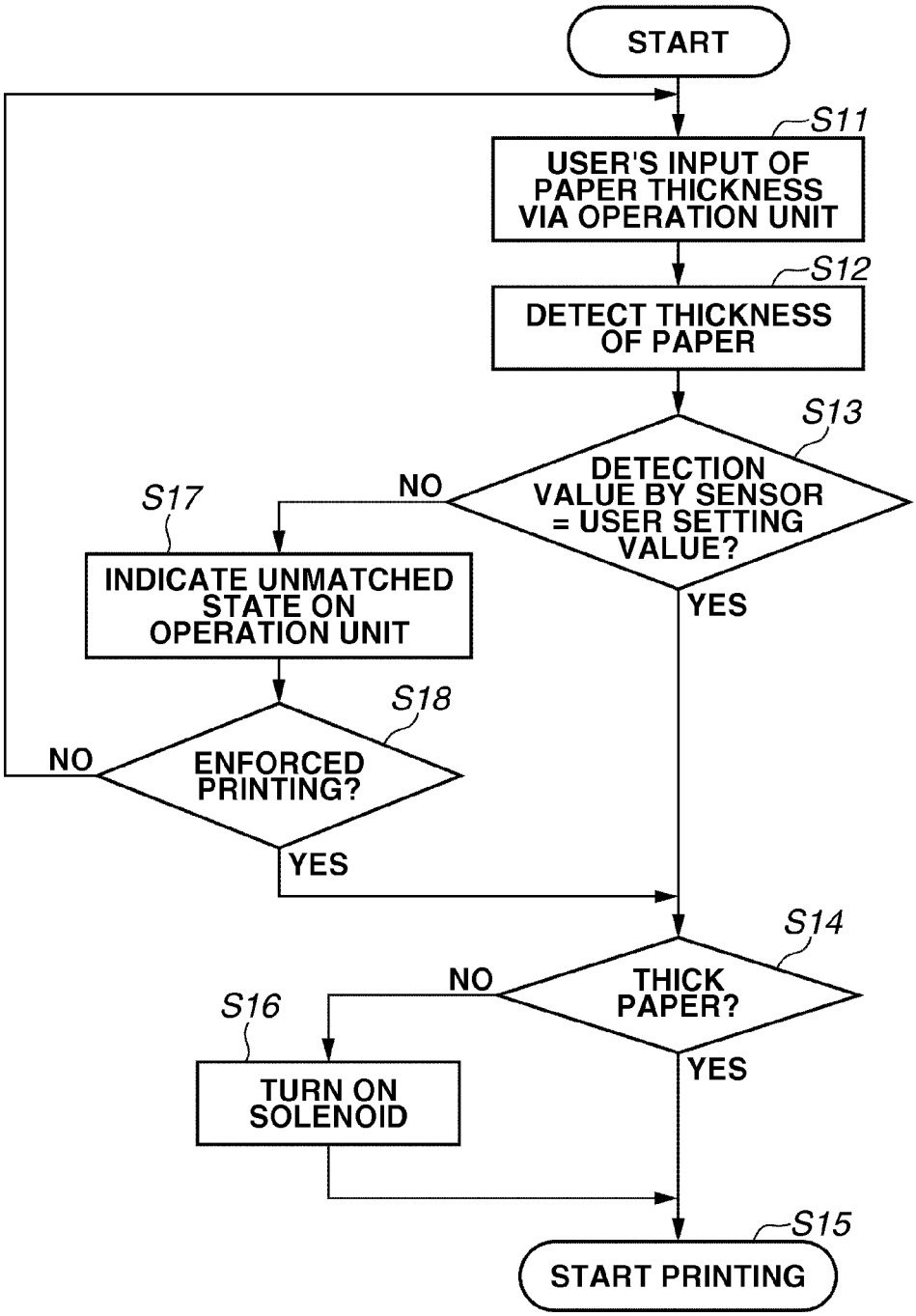
FIG. 20 is a flowchart illustrating an example operation performed by the control unit illustrated in FIG. 19.

FIG. 20 is a flowchart illustrating an example operation performed by the controller 500 to drive the projecting members 320. In step S11, in response to sheet information (e.g., paper thickness and paper size of the sheet S) entered via the operation unit 112 by a user, the controller 500 starts predetermined processing for printing. In step S12, the controller 500 causes the paper thickness detection sensor 111 provided in the conveyance unit 20 to detect the thickness of the sheet S.

In step S13, the controller 500 determines whether an output value from the paper thickness detection sensor 111 accords with the paper thickness information entered by the user. If the output value from the thick paper detection sensor 111 accords with the paper thickness information (YES in step S13), the processing proceeds to step S14.

In step S14, the controller 500 determines whether the sheet S is thick paper. If the sheet S is thick paper (YES in step S14), the processing proceeds to step S15.

In step S15, the controller 500 turns off the solenoid 106 to form the flat guide surfaces. Then, the controller 500 causes the image forming apparatus to start a printing operation. If the sheet S is thin paper (NO in step S14), the processing proceeds to step S16. In step S16, the controller 500 turns on the solenoid 106 to form the corrugated guide surfaces.

If the output value from the paper thickness detection sensor 111 disagrees with the paper thickness information entered via the operation unit 112 (NO in step S13), the processing proceeds to step S17. In step S17, the controller 500 causes the operation unit 112 to display an indication (or message) notifying a user of an unmatched result in the comparison between the sheet information entered by a user and the output value from the paper thickness detection sensor 111.

In step S18, the controller 500 determines whether enforced printing is selected by a user. According to an exemplary embodiment, the image forming apparatus allows a user to change the paper thickness information or instruct executing print processing without changing any information. For example, considering the conditions of a machine to be used or the humidity of a sheet, a user instructs the enforced printing if enhancing the sheet skew correction ability by forming the corrugated guide surfaces is effective even when the sheet is thick paper.

Figure 21A:
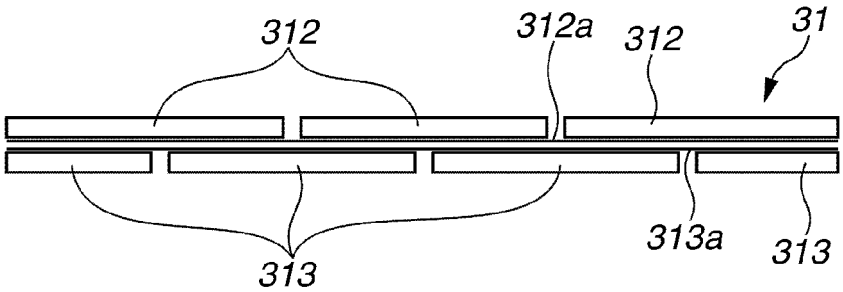
FIG. 21A is a front view illustrating an example state when a thick paper is passing through a skew correction apparatus according to a sixth exemplary embodiment of the present invention.
Figure 21B:
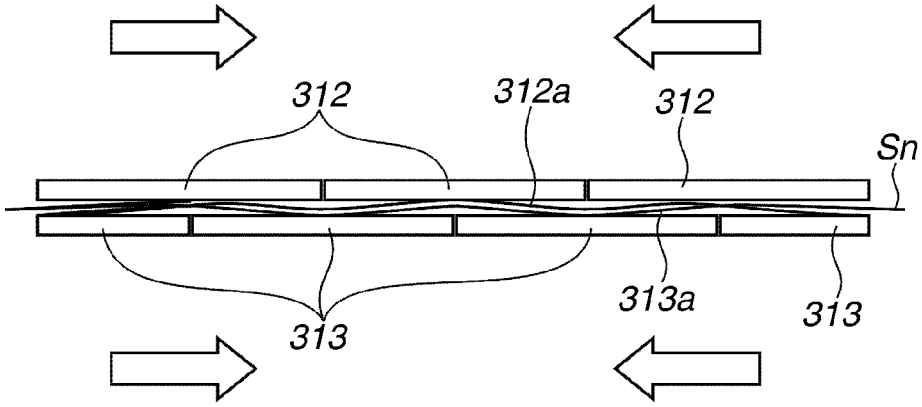
FIG. 21B is a front view illustrating an example state when a thin paper is passing through the skew correction apparatus according to the sixth exemplary embodiment of the present invention.
Figure 22:
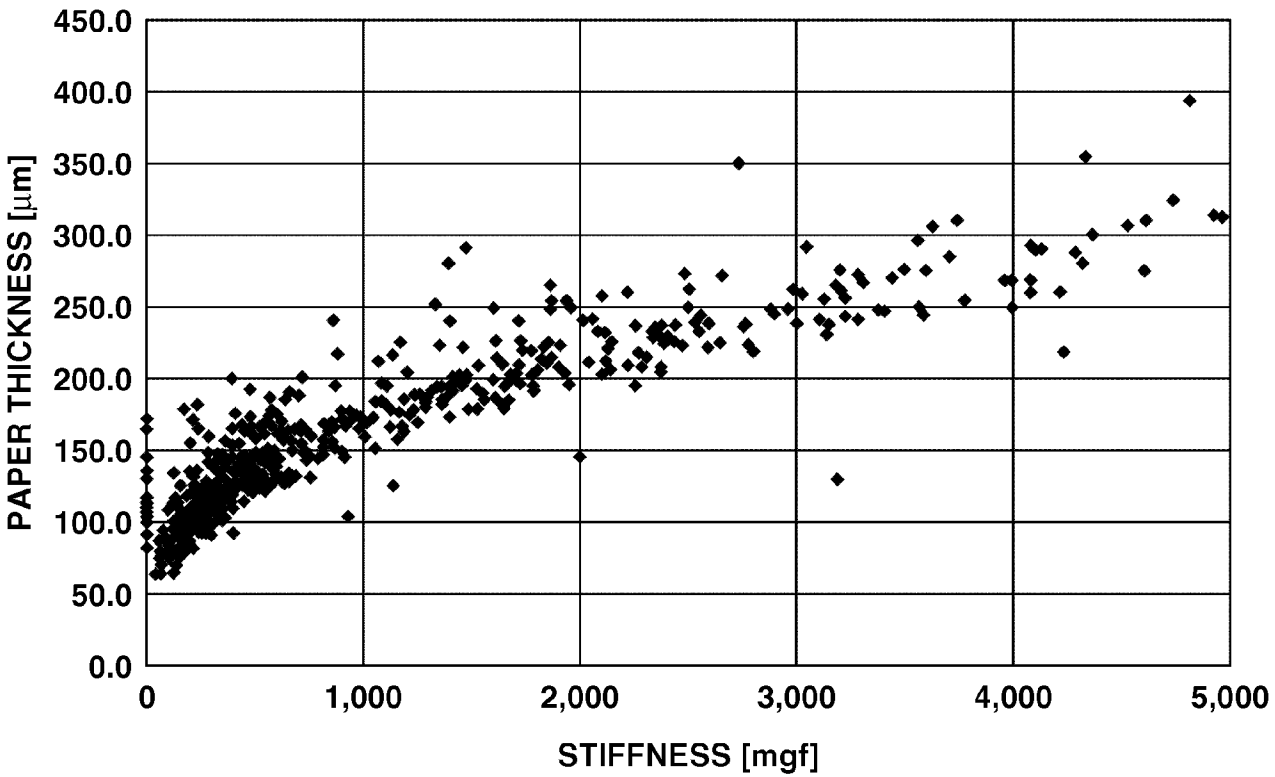
FIG. 22 is a graph illustrating an example relationship between sheet thickness and stiffness.

FIGS. 21A and 21B illustrate an example skew correction apparatus according to a sixth exemplary embodiment of the present invention.

As illustrated in FIG. 21A, the upper guide 312 and the lower guide 313 serving as a pair of upper and lower guide members are split into a plurality of guide boards arrayed along the sheet conveyance direction and spaced with a constant clearance between them. The split positions of the upper guide 312 are offset from the split positions of the lower guide 313. In an exemplary embodiment, the centers of the upper guide boards face the gaps between the lower guide boards.

An actuator (not illustrated) can change the clearances between the guide boards arrayed along the sheet conveyance direction. The sheet-like guide members 312*a* and 313*a* have portions fixed to the guide boards. To deform the sheet-like guide member 312*a* into a corrugated shape, the actuator (not illustrated) moves the guide boards of the upper guide 312 in the sheet conveyance direction to reduce the clearances between the guide boards. Similarly, to deform the sheet-like guide member 313*a* into a corrugated shape, an actuator (not illustrated) moves the guide boards of the lower guide 313 in the sheet conveyance direction to reduce the clearances between the guide boards.

According to the movement of the guide boards of the upper guide 312, the sheet-like guide member 312*a* deforms into a corrugated shape because the sheet-like guide member 312*a* is partly fixed to respective guide boards of the upper guide 312 (see FIG. 21B). The sheet-like guide member 313*a* provided on the lower guide 313 has an arrangement similar to that of the sheet-like guide member 312*a* provided on the upper guide 312. The split positions of the lower guide 313 are adjacent respectively to midpoints of the guide boards of the upper guide 312.

Therefore, as illustrated in FIG. 21B, a position where the sheet-like guide member 312*a* deforms in a convex shape is opposed to a position where the sheet-like guide member 313*a* deforms in a concave shape along the sheet conveyance direction. Furthermore, a position where the sheet-like guide member 312*a* deforms in a concave shape is opposed to a position where the sheet-like guide member 313*a* deforms in a convex shape along the sheet conveyance direction. In this manner, the sheet-like guide member 313*a* on the lower guide 313 and the sheet-like guide member 312*a* on the upper guide 312 deform correspondingly to form a corrugated sheet path having a constant clearance between them. Accordingly, the sixth exemplary embodiment can obtain effects similar to those of the fifth exemplary embodiment.

Application of the present invention is not limited to the above-described electrophotographic image forming apparatus. The present invention can be applied to another (e.g., an inkjet type or a thermal transfer type) image forming apparatus.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

What is claimed is:

1. A sheet conveyance apparatus comprising:
   - a reference surface extending along a sheet conveyance direction and configured to regulate the position of a side edge of a sheet to be conveyed;
   - a skew conveyance mechanism configured to convey the sheet obliquely so that the side edge of the sheet collides against the reference surface;
   - a guide unit provided between the reference surface and the skew conveyance mechanism and configured to guide the side edge of the sheet conveyed by the skew conveyance mechanism to the reference surface, the guide unit including a first guide having a sheet conveyance surface facing one surface of the sheet to be conveyed and a second guide having a sheet conveyance surface facing the other surface of the sheet to be conveyed;
   - a recessed portion provided on one of the sheet conveyance surface of the first guide and the sheet conveyance surface of the second guide; and
   - a protruding portion configured to protrude from the other of the sheet conveyance surface of the first guide and the sheet conveyance surface of the second guide, the protruding portion being opposed to the recessed portion and protruding into the recessed portion, wherein the protruding portion is urged in a protruded state.

2. The sheet conveyance apparatus according to claim 1, wherein the protruding portion includes a spherical member configured to be rotatably held by the first guide or the second guide.

3. The sheet conveyance apparatus according to claim 1, wherein the protruding portion includes a plurality of protruding portions, provided along a sheet conveyance direction, configured to protrude from the sheet conveyance surface of the first guide or the second guide.

4. The sheet conveyance apparatus according to claim 1, wherein the protruding portions can be moved in a direction intersecting with the sheet conveyance surface of the first guide or the second guide and urged in a protruding direction toward the recessed portion.

5. An image forming apparatus comprising:

an image forming unit configured to form an image on a sheet; and a sheet conveyance apparatus configured to convey the sheet to the image forming unit, wherein the sheet conveyance apparatus includes:

a reference surface extending along a sheet conveyance direction and configured to regulate the position of a side edge of a sheet to be conveyed;

a skew conveyance mechanism configured to convey the sheet obliquely so that the side edge of the sheet collides against the reference surface;

a guide unit provided between the reference surface and the skew conveyance mechanism and configured to guide the side edge of the sheet conveyed by the skew conveyance mechanism to the reference surface, the guide unit including a first guide having a sheet conveyance surface facing one surface of the sheet to be conveyed and a second guide having a sheet conveyance surface facing the other surface of the sheet to be conveyed;

a recessed portion provided on one of the sheet conveyance surface of the first guide and the sheet conveyance surface of the second guide; and a protruding portion configured to protrude from the other of the sheet conveyance surface of the first guide and the sheet conveyance surface of the second guide, the protruding portion being opposed to the recessed portion and protruding into the recessed portion, wherein the protruding portion is urged in a protruded state.

6. The image forming apparatus according to claim 5, wherein the protruding portion includes a spherical member configured to be rotatably held by the first guide or the second guide.

7. The image forming apparatus according to claim 5, wherein the protruding portion includes a plurality of protruding portions, provided along a sheet conveyance direction, configured to protrude from the sheet conveyance surface of the first guide or the second guide.

8. The image forming apparatus according to claim 5, wherein the protruding portions can be moved in a direction intersecting with the sheet conveyance surface of the first guide or the second guide and urged in a protruding direction toward the recessed portion.

* * * * *